US006692115B2

(12) United States Patent
Sanada et al.

(10) Patent No.: US 6,692,115 B2
(45) Date of Patent: Feb. 17, 2004

(54) LIQUID CONTAINER, LIQUID SUPPLY SYSTEM AND LIQUID DISCHARGE RECORDING APPARATUS

(75) Inventors: Mikio Sanada, Kanagawa (JP); Sadayuki Sugama, Ibaraki (JP); Hiroki Hayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 09/985,515

(22) Filed: Nov. 5, 2001

(65) Prior Publication Data

US 2002/0085074 A1 Jul. 4, 2002

(30) Foreign Application Priority Data

Nov. 8, 2000 (JP) ..... 2000/340646

(51) Int. Cl.[7] ..... B41J 2/175
(52) U.S. Cl. ..... 347/85; 347/86
(58) Field of Search ..... 347/84, 85, 86, 347/87; 210/321.8

(56) References Cited

U.S. PATENT DOCUMENTS 4,940,542 A * 7/1990 Simizu et al. ..... 210/321.8

FOREIGN PATENT DOCUMENTS

GB 2058802 * 9/1980 ..... C08J/9/42

* cited by examiner

*Primary Examiner*—Anh T. N. Vo
(74) *Attorney, Agent, or Firm*—Fitzpatrick, Cella, Harper & Scinto

(57) ABSTRACT

The invention provides a liquid container containing an absorbent member for temporarily retaining, by a capillary force, liquid to be supplied to a recording head for discharging the liquid and mounted together with the recording head on a linearly reciprocating carriage and adapted for receiving liquid replenishment to the absorbent member when the carriage is moved to a predetermined position, wherein, to the surface of the absorbent member, there is applied a polymer provided with a second portion having a lyophilic radical for rendering the surface lyophilic and a first portion having a radical of an interfacial energy different from the interfacial energy of the lyophilic radical but is approximately equal to the surfacial energy of the surface, and the first portion is oriented toward the surface while the second portion is oriented in a direction different from the surface.

10 Claims, 22 Drawing Sheets

UNTREATED 150×

UNTREATED 500×

UNTREATED 2000×

ACIDIZED 150×

HYDROPHILICALLY TREATED 150×

HYDROPHILICALLY TREATED 500×

HYDROPHILICALLY TREATED 2000×

LIQUID CONTAINER, LIQUID SUPPLY SYSTEM AND LIQUID DISCHARGE RECORDING APPARATUS

BACKGROUND OF THE INVENTION

1. Field of the Invention

The present invention relates to a liquid supply system for supplying a tank mounted on a carriage, executing a reciprocating motion and supporting a recording head and the tank, with ink from a replenishing tank different from the tank on the carriage when the carriage moves to a predetermined position, and a liquid discharge recording apparatus provided with such liquid supply system.

2. Related Background Art

A conventional liquid discharge recording apparatus is disclosed in the Japanese Patent Application Laid-open Nos. 9-234881 and 10-29318. In the liquid discharge recording apparatus disclosed therein is provided, on a reciprocably supported carriage, with a tank unit containing ink constituting recording liquid and a recording head for discharging the ink, supplied from such tank unit, toward a recording medium such as a recording sheet. The recording sheet is conveyed by conveying means, and the carriage executes a reciprocating motion along a line in the transversal direction of the recording sheet, perpendicular to the conveying direction. The recording head on the carriage discharges the ink toward the recording sheet in the course of the reciprocating motion of the carriage, thereby recording an image on the recording sheet. The tank unit on the carriage contains an absorbent member for holding ink by absorbing ink therein. Such absorbent member can be composed, for example, of a porous member such as sponge or a fibrous body.

The liquid discharge recording apparatus described in the aforementioned patent applications is provided with a replenishing tank different from the tank supported on the carriage. The replenishing tank contains ink for replenishment to the tank unit on the carriage. The replenishing tank is fixed for example to the housing of the liquid discharge recording apparatus, in the vicinity of the moving range of the carriage. To the replenishing tank, there is connected an end of a tubular liquid supply path for supplying the tank unit on the carriage with the ink contained in such replenishing tank. In the ink replenishment to the tank unit on the carriage, the carriage is moved to a predetermined position or a replenishing position to the tank unit, and the ink in the replenishing tank is supplied through the liquid supply path to the tank unit on the carriage stopped at such replenishing position. In such liquid discharge recording apparatus of so-called pit-in system, the ink is replenished from the replenishing tank to the tank unit before all the ink therein is consumed in the recording operation.

In the recording apparatus of the above-described pit-in system, it is being required to reduce the ink supply time from the replenishing tank to the ink tank and to rapidly move the carriage from the predetermined replenishing position to the recording area, in order to improve the throughput.

However, in the above-described conventional liquid discharge recording apparatus, a shortened ink supply time may result in a defective printing or ink leakage from the ink tank since the absorbent member is incapable of rapidly absorbing the replenished ink.

Also in such liquid discharge recording apparatus, in the liquid supply path for supplying the ink from the replenishing tank, fixed for example on the housing, to the tank unit on the carriage, the ink may drip off from the end portion of the liquid supply path for example by a vibration generated in the movement of the carriage, thus resulting in ink leakage. Also in case the ink supply path is so constructed that the end portion of the supply tube extending from the replenishing tank extends downwards parallel to the direction of gravity, so as to form a meniscus at the end portion of the supply tube in the interval of the replenishing operations, such meniscus has to be maintained in stable manner throughout the interval of the replenishing operations in order that the ink replenishing operation can be stably and securely executed. If the meniscus is formed unstably in such ink supply path, the meniscus may be easily broken for example by a vibration, thus leading to ink leakage.

SUMMARY OF THE INVENTION

In consideration of the foregoing, an object of the present invention is to provide, for use in a liquid discharge recording apparatus provided with a carriage supporting a tank unit containing an absorbent member and a recording head and adapted to replenish ink from a replenishing tank to the tank unit on the carriage when the carriage moves to a predetermined position, a liquid supply system enabling rapid absorption of the ink in the absorbent member thereby allowing prompt ink replenishment, a liquid discharge recording apparatus provided with such liquid supply system, and a liquid container adapted for use as the tank unit to be supported on the carriage.

Another object of the present invention is to provide, for use in the above-mentioned liquid discharge recording apparatus, a liquid supply system ensuring highly reliable ink supply without ink leakage in the ink supply path from the replenishing tank to the tank unit on the carriage, and a liquid discharge recording apparatus provided with such liquid supply system.

The above-mentioned objects can be attained, according to the present invention, by a liquid container containing therein an absorbent member for temporarily supporting, by a capillary force, liquid to be supplied to a recording head for discharging liquid and mounted together with the recording head on a linearly reciprocating carriage and subjected to liquid replenishment to the absorbent member when the carriage is moved to a predetermined position, wherein the surface of the absorbent member is applied with a polymer including a second portion having a lyophilic radical for providing the surface with lyophilicity and also including a first portion having a radical of an interfacial energy different from that of the aforementioned lyophilic radical and approximately equal to the surface energy of the aforementioned surface, and the first portion is oriented toward the surface while the second portion is oriented in a direction different from the surface.

According to the present invention, there is also provided a liquid supply system comprising a tank unit containing therein an absorbent member for temporarily supporting, by a capillary force, liquid to be supplied to a recording head for discharging liquid and mounted together with the aforementioned recording head on a linearly reciprocating carriage, and a replenishing tank containing liquid to be replenished to the tank unit when the carriage is moved to a predetermined position, wherein the surface of the absorbent member is applied with a polymer including a second portion having a lyophilic radical for providing the surface with lyophilicity and also including a first portion having a radical of an interfacial energy different from that of the aforementioned lyophilic radical and approximately equal to the surfacial energy of the aforementioned surface, and the first portion is oriented toward the surface while the second portion is oriented in a direction different from the surface.

According to the present invention, there is further provided a liquid supply system comprising a tank unit containing liquid to be supplied to a recording head for discharging liquid and mounted together with the aforementioned recording head on a linearly reciprocating carriage, a replenishing tank containing liquid to be replenished to the tank unit when the carriage is moved to a predetermined position, and a tubular liquid supply path of which an end is connected to the replenishing tank for supplying the tank unit with the liquid contained in the replenishing tank while the other end is positioned above the tank unit when the carriage is moved to the aforementioned predetermined position, wherein the internal surface of the liquid supply path is applied with a polymer including a second portion having a lyophilic radical for providing the internal surface with lyophilicity and also including a first portion having a radical of an interfacial energy different from that of the aforementioned lyophilic radical and approximately equal to the surfacial energy of the aforementioned internal surface, and the first portion is oriented toward the internal surface while the second portion is oriented in a direction different from the surface.

According to the present invention, there is further provided a liquid supply system comprising a tank unit containing therein an absorbent member for temporarily supporting, by a capillary force, liquid to be supplied to a recording head for discharging liquid and mounted together with the aforementioned recording head on a linearly reciprocating carriage, a replenishing tank containing liquid to be replenished to the tank unit when the carriage is moved to a predetermined position, and a tubular liquid supply path of which an end is connected to the replenishing tank for supplying the tank unit with the liquid contained in the replenishing tank while the other end is positioned above the tank unit when the carriage is moved to the aforementioned predetermined position, wherein the surface of the absorbent member and the internal surface of the liquid supply path are rendered lyophilic and each of such lyophilicized surfaces is applied with a polymer including a second portion having a lyophilic radical for providing the surface with lyophilicity and also including a first portion having a radical of an interfacial energy different from that of the aforementioned lyophilic radical and approximately equal to the surfacial energy of the aforementioned internal surface, and the first portion is oriented toward the internal surface while the second portion is oriented in a direction different from the surface.

According to the present invention, there is further provided a liquid discharge recording apparatus comprising a carriage supporting a tank unit containing therein an absorbent member for temporarily supporting liquid by a capillary force and a recording head for executing a recording operation by discharging the liquid supplied from the tank unit toward a recording medium, and adapted to reciprocate along a line parallel to the recording medium, and a replenishing tank containing liquid to be replenished to the tank unit when the carriage is moved to a predetermined position, wherein the surface of the absorbent member is applied with a polymer including a second portion having a lyophilic radical for providing the surface with lyophilicity and also including a first portion having a radical of an interfacial energy different from that of the aforementioned lyophilic radical and approximately equal to the surfacial energy of the aforementioned surface, and the first portion is oriented toward the internal surface while the second portion is oriented in a direction different from the surface.

Preferably the aforementioned liquid discharge recording apparatus further comprises a tubular liquid supply path of which an end is connected to the replenishing tank for supplying the tank unit with the liquid contained in the replenishing tank while the other end is positioned above the tank unit when the carriage is moved to the aforementioned predetermined position, wherein the internal surface of the liquid supply path is applied with a polymer including a second portion having a lyophilic radical for providing the internal surface with lyophilicity and also including a first portion having a radical of an interfacial energy different from that of the aforementioned lyophilic radical and approximately equal to the surfacial energy of the aforementioned internal surface, and the first portion is oriented toward the internal surface while the second portion is oriented in a direction different from the surface.

Furthermore, in the aforementioned liquid discharge recording apparatus, the replenishing tank may be provided in plural units with different kinds of liquids contained therein, and the tank unit may be provided in plural units respectively corresponding to the kinds of the replenishing tanks.

In the foregoing inventions, it is preferred that the absorbent member is composed of a fibrous body having olefinic resin at least on the surface thereof and the polymer is composed of polyalkyl siloxane provided with a lyophilic radical.

It is further preferred that the internal surface, provided with the polymer, of the aforementioned liquid supply path is composed of an olefinic resin and the polymer is composed of polyalkyl siloxane provided with a lyophilic radical.

According to the present invention described in the foregoing, the surface of the absorbent member, contained in the liquid container supported as the tank unit on the carriage, there is provided a polymer including a second portion having a lyophilic radical and a first portion having a radical of an interfacial energy different from that of the aforementioned lyophilic radical and approximately equal to the surfacial energy of the aforementioned surface, and the first portion is oriented toward the aforementioned surface while the second portion is oriented in a direction different from the surface, whereby the surface of the absorbent member is rendered lyophilic. In such configuration, when the liquid is replenished from the replenishing tank to the absorbent member in the liquid container when the carriage supporting the recording head together with the liquid container is moved to the predetermined position, the replenished liquid promptly absorbed in the absorbent member because the surface thereof is lyophilized, whereby the liquid replenishing operation into the liquid container can be completed within a short time. In a liquid supply system or a liquid discharge recording apparatus in which such liquid container is mounted as the tank unit together with the recording head on the carriage, when the liquid is replenished to the absorbent member in the tank unit in case the liquid therein decreases by the liquid discharging operation of the recording head, the liquid penetrating in the absorbent member reaches the gas-liquid interface therein within a short time. Thus the liquid present in the absorbent member prior to the replenishment becomes connected with the replenished liquid. In comparison with a case where the surface of the absorbent member is not rendered hydrophilic, there is significantly reduced the time required for the tank unit to reach a usable state after replenishment. It is therefore possible to achieve the liquid replenishment to the tank unit within a short time and to reduce the time from the start of the liquid replenishing operation to the sufficient filling of the usable liquid in the tank unit. In this manner, the lyophilizing treatment of the absorbent member in the tank unit enables prompr and secure liquid replenishment into the absorbent member. Consequently there can be realized a highly reliable liquid discharge recording apparatus of pit-in system in which the liquid replenishment to the tank unit mounted on the carriage is executed in a predetermined position.

Also in a liquid supply system or a liquid discharge recording apparatus in which the above-described liquid container is mounted as the tank unit on the carriage and the liquid in the replenishing tank is replenished to the tank unit through a tubular liquid supply path when the carriage is moved to a predetermined position, the lyophilized internal surface of the liquid supply path allows to form a stable meniscus at the end portion of the liquid supply path during the interval of the liquid replenishing operations. Thus, even in case a vibration is generated in the recording apparatus for example by the carriage movement or an impact is applied to the recording apparatus, the meniscus is stably supported at the end portion of the liquid supply path and is not easily broken. Therefore, the liquid leakage from the end portion of the liquid supply path in the interval of the liquid replenishing operations to the tank unit on the carriage, and there can be secured highly reliable liquid replenishment to the tank unit.

BRIEF DESCRIPTION OF THE DRAWINGS

FIGS. 8A and 8B are views schematically showing, in a surface modifying method employable in the present invention, the application state of polymer molecules of a surface modifying agent on the surface to be modified of an article, wherein FIG. 8A shows a case where a functional second radical and a first radical for adhesion to the surface of the article are both present in side chains of the polymer, while FIG. 8B shows a case where the first radical is contained in the main chain of the polymer;

FIGS. 16A, 16B, 16C and 16D are views showing a PE-PP fibrous body utilizable as the ink absorbent member in the ink tank, wherein FIG. 16A shows the mode of use as the ink absorbent member in the ink tank, FIG. 16B shows the entire form of the PE-PP fibrous body together with a fiber orienting direction F1 and a direction F2 perpendicular thereto, FIG. 16C shows a state prior to the formation of the PE-PP fibrous body by thermal fusion, and FIG. 16D shows a state of the PE-PP fibrous body formed by thermal fusion;

FIGS. 17A and 17B are views showing examples of the cross-sectional structure of the PE-PP fibrous body shown in FIGS. 16A, 16B, 16C and 16D wherein FIG. 17A shows an example where a PE sheath material covers a PP core material in substantially concentric manner while FIG. 17B shows an example where the PE sheath material covers the PP core material in excentric manner;

FIGS. 18A, 18B and 18C are views showing an example of applying the surface modifying method of the present invention to the hydrophilic processing of the water-repellent surface of the PE-PP fibrous body shown in FIGS. 16A, 16B, 16C and 16D, wherein FIG. 18A shows an unprocessed fibrous body, FIG. 18B shows a step of immersing the fibrous body in hydrophilic processing liquid and FIG. 18C shows a step of compressing the fibrous body after the immersion thereby eliminating the surplus processing liquid;

FIGS. 19A, 19B and 19C are views showing steps succeeding to those shown in FIGS. 18A, 18B and 18C, wherein FIG. 19A shows a coated layer formed on the surface of the fibrous body, FIG. 19B shows a step of eliminating the solvent contained in the coated layer by drying, and FIG. 19C shows a covering layere of the hydrophilic processing agent on the surface of the fibers;

DETAILED DESCRIPTION OF THE PREFERRED EMBODIMENTS

Now the present invention will be clarified in detail by embodiments thereof, with reference to the accompanying drawings. In the present invention, a property easily wetted by the contained liquid is called "lyophilicity", and, in the following description, there will be explained a case of hydrophilicity among such lyophilicity, taking an example of employing aqueous ink as the ink. However, the kind of the ink to be employed in the present invention is not limited to aqueous, but can also be oil-based, and, in such case, the surface is to be provided with oleophilicity.

Figure 1:
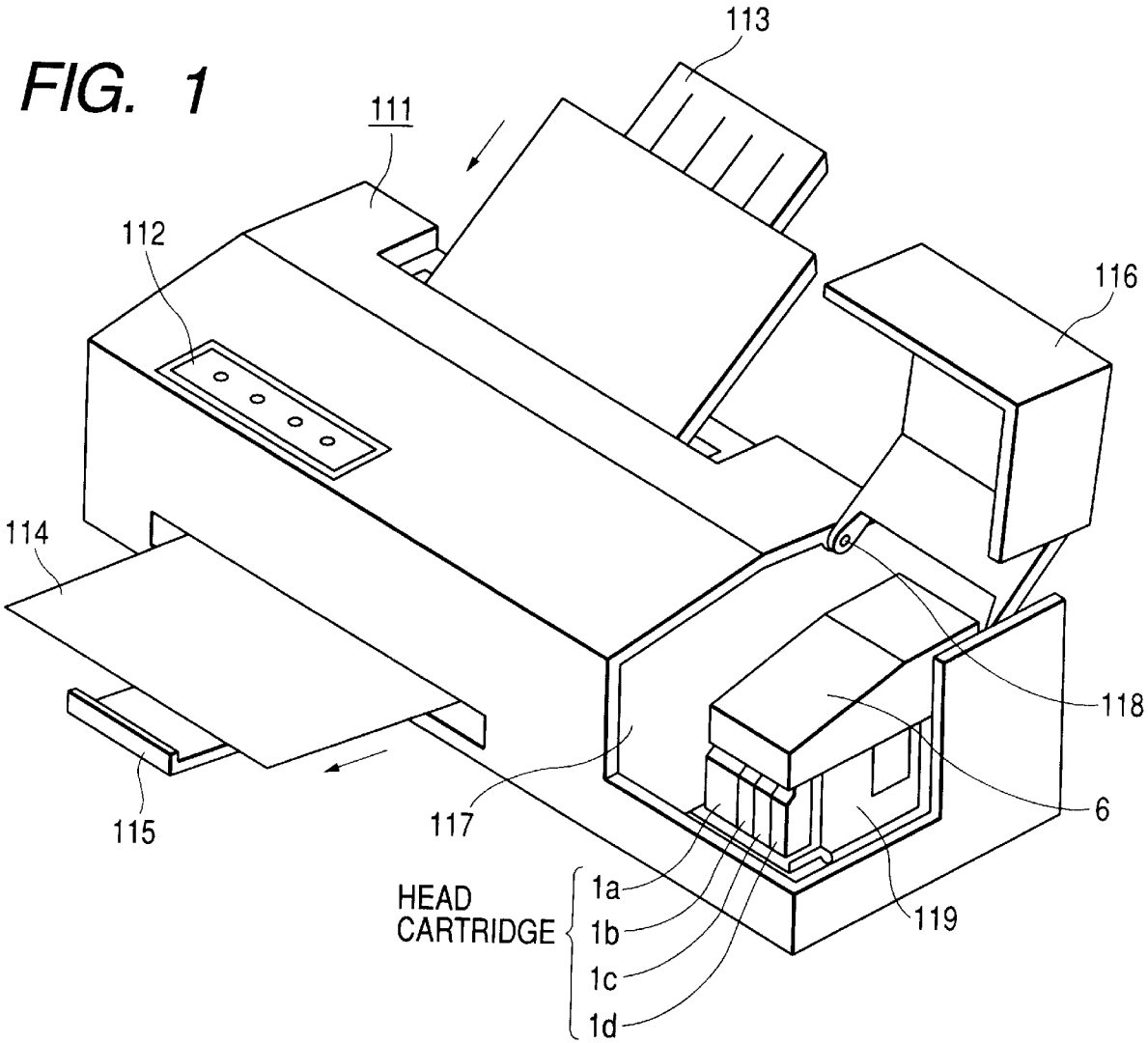
FIG. 1 is a schematic perspective view of a color printer constituting a liquid discharge recording apparatus embodying the present invention.

FIG. 1 is a schematic perspective view of a color printer, constituting a liquid discharge recording apparatus embodying the present invention.

As shown in FIG. 1, the color printer 111 of the pit-in system constituting the liquid discharge recording apparatus of the present embodiment is provided with an operation panel 112 in the upper front portion of a housing. In the rear portion of the color printer 111, there is provided a sheet feeding tray 113 for supporting a paper sheet (recording medium) prior to recording, and the sheet 114 on the sheet feeding tray 113 is supplied into the color printer 111. The sheet 114 discharged through a paper conveying path in the color printer 111 is discharged onto a paper discharge tray 115 provided in the lower front portion of the color printer 111. In the front right portion of the aforementioned housing of the color printer 111, there is formed an aperture 117, covered by a main body cover 116 which is rotatably mounted by a hinge 118 on the internal end portion of the aperture 117.

Inside the aforementioned housing of the color printer 111, there is provided a carriage 119 supported by a guide member (not shown). The carriage 119 is rendered capable of linear reciprocating motion along the transversal direction of the sheet passing through the aforementioned conveying path. On the carriage 119, there is mounted a head cartridge (1*a*, 1*b*, 1*c*, 1*d*) integrally including a recording head for discharging recording liquids or inks, and liquid containers or ink tanks respectively containing inks of black (Bk), cyan (C), magenta (M) and yellow (Y) colors to be supplied to the recording head. Therefore, the tank units respectively corresponding to the aforementioned colors are mounted, together with the recording head, on the carriage 119. Each tank unit on the carriage 119 contains an absorbent member for temporarily holding, by a capillary force, the ink to be supplied to the recording head.

In a space in the vicinity of the aperture 117 of the color printer 111, there is mounted a large tank 6 constituting a replenishing tank for the black ink. The ink contained in the large black tank 6 is replenished to the black head cartridge 1*a* by a replenishing method to be explained later. In the following there will be explained an ink supply system for supplying the tank unit on the carriage with the ink in the liquid discharge recording apparatus of the present invention.

Figure 2:
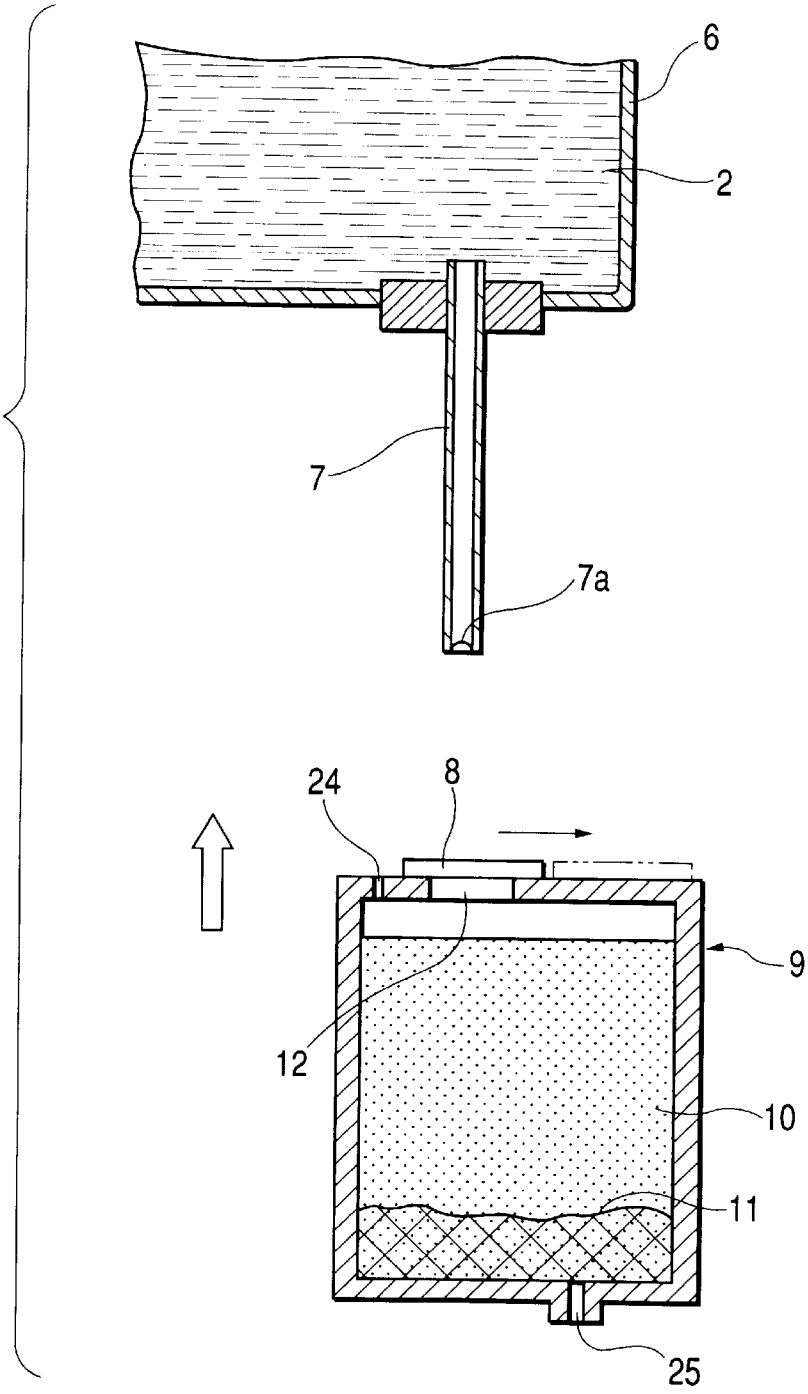
FIG. 2 is a schematic view showing the connection and supply between a large tank shown in FIG. 1 and a tank unit in a head cartridge.
Figure 3:
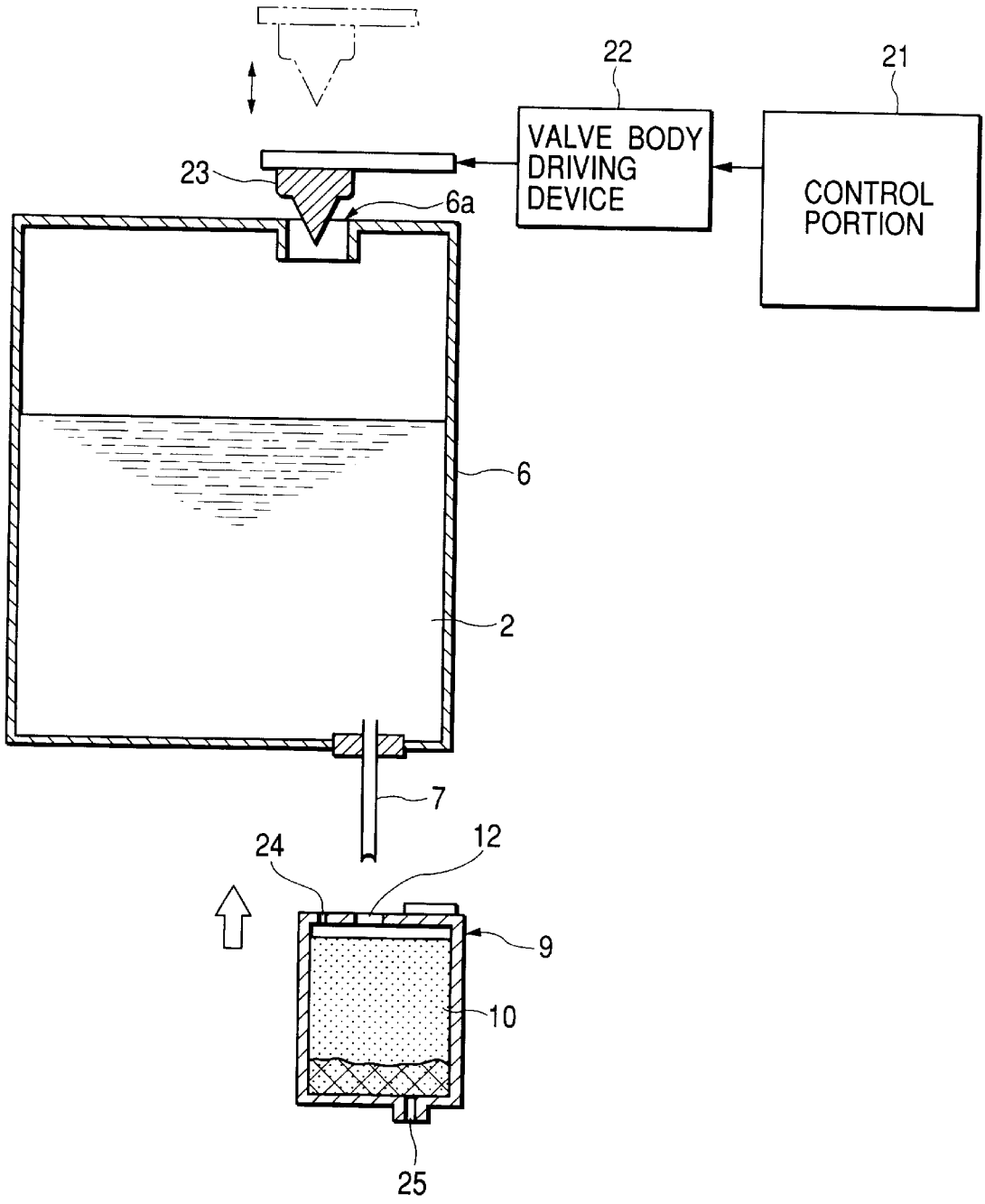
FIG. 3 is a schematic view showing an ink supply system from the large tank to the tank unit.

FIG. 2 is a schematic view showing the connection for supply between the large tank and the tank unit of the head cartridge shown in FIG. 1, and FIG. 3 is a schematic view showing the ink supply system from the large tank to the tank unit.

As shown in FIG. 2, a tank unit 9 of the head cartridge, containing liquid of high frequency of use, contains a negative pressure generating member 10 as an absorbent member for absorbing and retaining liquid. In the present embodiment, the negative pressure generating member 10 in the present embodiment is composed of a PP fibrous body (an intertwined body of polypropylene fibers). The negative pressure generating member 10 is provided in almost all the space of the tank unit 9 except a portion thereof in the vicinity of the upper wall. The surface of the PP fibers constituting the negative pressure generating member 10 is hydrophilically processed by a method to be explained later. Since the fibers constituting the negative pressure generating member 10 are hydrophilically processed, the ink 2 replenished from the replenishing tank to the tank unit 9 is promptly absorbed in the negative pressure generating member 10 whereby the ink replenishing operation can be completed within a short time.

At the bottom face of the large tank 6, there is connected an end of a supply pipe 7 constituting a tubular supply path for supplying the ink 2, contained in the large tank 6, into the tank unit 9. In the present embodiment, the supply pipe 7 extends in the direction of gravity, and the other end thereof is positioned above the tank unit 9 when the carriage 119 is moved to a predetermined ink replenishing position for ink replenishment to the tank unit 9.

In the upper wall of the tank unit 9, there is provided an inserting aperture 12 for inserting the end portion of the supply pipe 7 of the large tank 6 containing liquid therein, and there is also movably provided a slide plate 8 for opening and closing the inserting aperture 12. The insertion of the supply pipe 7 into the inserting aperture 12 is achieved by the movement of the tank unit 9 toward the large tank 6 by the movement of the head cartridge while the inserting aperture 12 is opened by the movement of the slid plate 8. In the upper wall of the tank unit 9 there is provided an exterior communicating hole for communication of the internal space of the tank unit 9 with the external air, and, in the lower part of the tank unit 9, there is provided an ink supply aperture 25 for supplying the ink in the tank unit 9 to the recording head of the head cartridge.

In the present embodiment, the ink replenishing operation to the tank unit 9 is controlled by a control portion 21 shown in FIG. 3. When the ink in the tank unit 9 is consumed by the recording operation of the recording head of the head cartridge and the control portion 21 judges that the remaining ink amount in the tank unit 9 is low, the supply pipe 7 is inserted into the inserting aperture 12 of the tank unit 9 under the instruction of the control portion 21 and the ink is replenished from the large tank 6 into the negative pressure generating member 10 in the tank unit 9 through the supply pipe 7.

The judgment of the low remaining ink amount in the tank unit 9 has to be given before the ink retained in the negative pressure generating member 10 runs out, and is preferably given before the ink flow to the ink supply aperture 25 at the lower part of the tank unit 9 is interrupted, namely before the gas-liquid interface 11 in the negative pressure generating member 10 becomes lower than a predetermined height. This is because, if the ink runs out in the negative pressure generating member 10 in the vicinity of the ink supply aperture 25, the ink flow becomes interrupted at the ink supply aperture 25 and air may intrude in the ink supply aperture 25 or in the head unit.

The timing for starting the ink replenishing operation can be identified from the judgment of the remaining ink amount in the negative pressure generating member 10 based on the consumption amount of the ink in the recording head. For example it is possible to confirm in advance the number of the liquid droplets (dot count) discharged from the recording head, corresponding to the complete exhaustion of the ink in the tank unit 9, then to store, in the control portion 21, a set value obtained by adding a safety value in order that the ink in the tank unit 9 is not completely exhausted, to the aforementioned dot count, and to initiate the replenishing operation when the number of dots reaches such set value. There may also be employed a method of setting a predetermined time within a range that the ink is not exhausted even in solid printing on the recording sheet and starting the replenishing operation taking such predetermined time as reference, or a method of initiating the replenishing operation at an arbitrary time within an interval in which the recording operation is not executed. In any case, the replenishing operation may be started at a time not related to the recording operation, such as at the discharge of the recording sheet after recording, whereby the ink replenishment can be realized without affecting the throughput of the recording.

On the other hand, as shown in FIG. 3, the upper wall of the large tank 6 is provided with an air communicating hole 6*a* for communication of the interior of the tank with the external air. The air communicating hole 6*a* is normally closed by a valve body 23. The air communicating hole 6*a* being thus closed, the interior of the large tank 6*a* is totally enclosed except the supply pipe 7. Therefore the ink 2 is retained in the large tank 6 in a state with a meniscus 7*a* at the end portion of the supply pipe 7.

Figure 4:
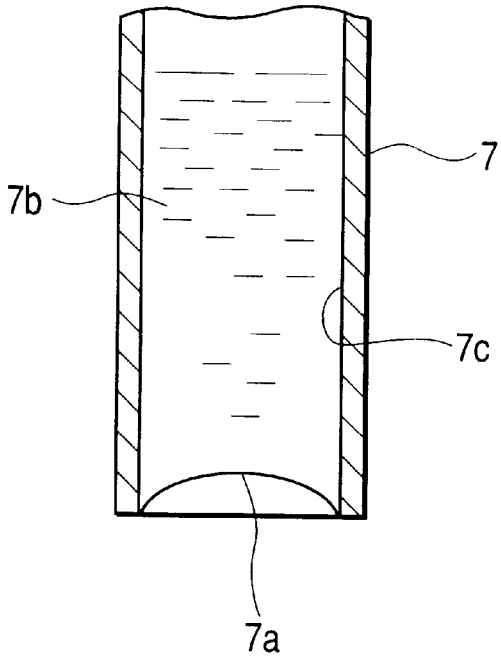
FIG. 4 is a cross-sectional view showing a state of meniscus formation at the end portion of a supply tube connected to the large tank.

FIG. 4 is a cross-sectional view showing a state where a meniscus is formed at the end portion of the supply pipe 7 connected to the large tank 6.

In the present embodiment, the internal wall 7*c* of the supply pipe 7 is hydrophilically processed by a method to be explained later, in order that the meniscus 7*a* is stably formed at the end portion of the supply pipe 7 as shown in FIG. 4. The hydrophilic processing of the internal wall 7*c* of the supply pipe 7 enables that the meniscus 7*a* is maintained in stable manner and is not easily broken even in case a vibration is generated for example by the carriage movement in the recording apparatus or an impact is applied thereto. Consequently, in the interval of the ink replenishing operations to the tank unit 9, the meniscus 7*a* continues to be formed in stable state, and the dripping of the ink 7*b* from the end portion of the supply pipe 7 can be prevented. As a result, there can be prevented the leakage of the ink 7*b* from the supply pipe 7 and highly reliable ink supply can be ensured in the ink replenishment to the tank unit 9. In order that the meniscus 7*a* is stably formed at the end portion of the supply pipe 7 in the downstream side in the ink supplying direction, there is only required the hydrophilic processing at least on the internal wall of such end portion.

Figure 5:
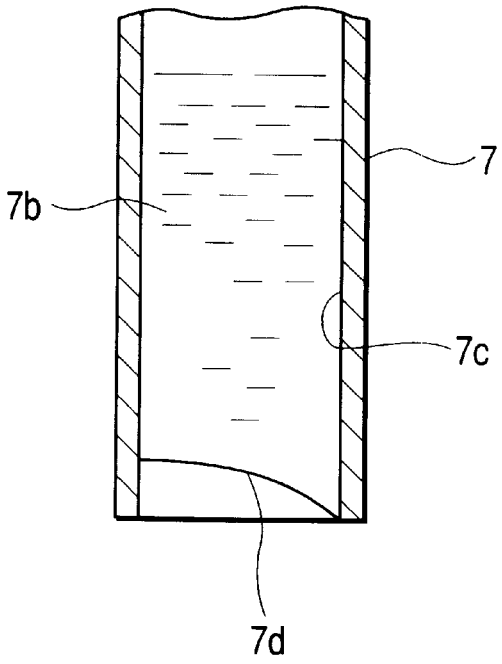
FIG. 5 is a cross-sectional view showing an example of the state of meniscus in case the internal wall surface of the supply tube is not hydrophilized.

FIG. 5 is a cross-sectional view showing an example of the state of the meniscus in case the internal wall 7*c* of the supply pipe 7 is not hydrophilically processed. In case the internal wall 7*c* of the supply pipe 7 is not hydrophilically processed, the meniscus 7*d* may be formed in an inclined manner as shown in FIG. 5, for example by ink solidification on the end portion of the internal wall 7*c* of the supply pipe 7 or by a change in the property of such portion to the ink. In such case, the meniscus may be unstably formed at the end portion of the supply pipe 7 and may be easily broken for example by vibration or impact, eventually resulting in ink leakage from the supply pipe 7. Such ink leakage can be prevented by hydrophilic processing of the internal wall 7*c* of the supply pipe 7.

In the following there will be explained the ink replenishing operation to the tank unit 9.

In the ink supply system shown in FIG. 5, when the control portion 21 permits the ink replenishment based on the remaining ink amount in the tank unit 9 judged from the ink consumption amount, the carriage is so moved that the tank unit 9 positioned below the large tank 6 is displaced toward the large tank 6 and the supply pipe 7 is inserted into the inserting aperture 12. Thereafter, under the instruction of the control portion 21, a valve body driving device 22 is activated to open a valve body 23, closing the communicating hole 6*a* of the large tank 6, for a certain time. Thus, a predetermined amount of the ink is supplied from the end portion of the supply pipe 7 into the tank unit 9. The ink supplied into the tank unit 9 is absorbed and retained in the negative pressure generating member 10.

Figure 6:
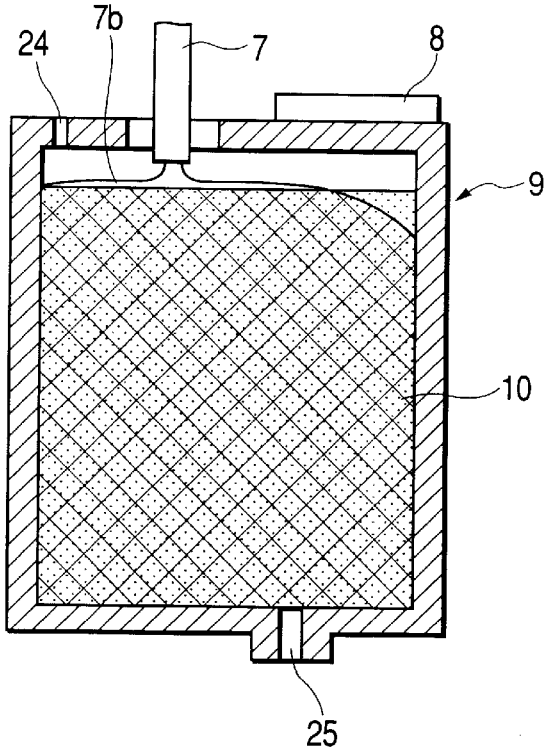
FIG. 6 is a cross-sectional view showing a state in which ink is absorbed in a negative pressure generating member in the tank unit.

FIG. 6 is a cross-sectional view showing a state where the ink is absorbed in the negative pressure generating member 10 in the tank unit 9, wherein an ink absorbing area in the negative pressure generating member 10 is represented by a hatched area. Since the surface of the fibers in the PP fibrous body constituting the negative pressure generating member 10 is hydrophilic processed as explained in the foregoing, the negative pressure generating member 10 can absorb the ink at a high speed, and the ink supplied to the upper surface of the negative pressure generating member 10 starts to be absorbed therein within a time less than one second. Therefore, when the ink is supplied through the supply pipe 7 to the upper surface of the negative pressure generating member 10 in a state where the gas-liquid interface 11 therein is low as shown in FIGS. 2 and 3, the supplied ink is promptly absorbed in the negative pressure generating member 10 and the ink penetrating therein reaches the gas-liquid interface 11 in a short time. In the present embodiment, therefore, the ink present in the negative pressure generating member 10 prior to the ink replenishment and the replenished ink are mutually connected within a short time in the negative pressure generating member 10 as shown in FIG. 6, whereby the time required by the tank unit 9 to reach the usable state is significantly shortened in comparison with a case where the surface of the fibers constituting the negative pressure generating member 10 is not hydrophilically processed. Consequently the ink replenishment to the tank unit 9 can be executed within a short time and there can be shortened the time from the start of the ink replenishing operation to the sufficient filling of the usable ink in the tank unit 9.

Figure 7:
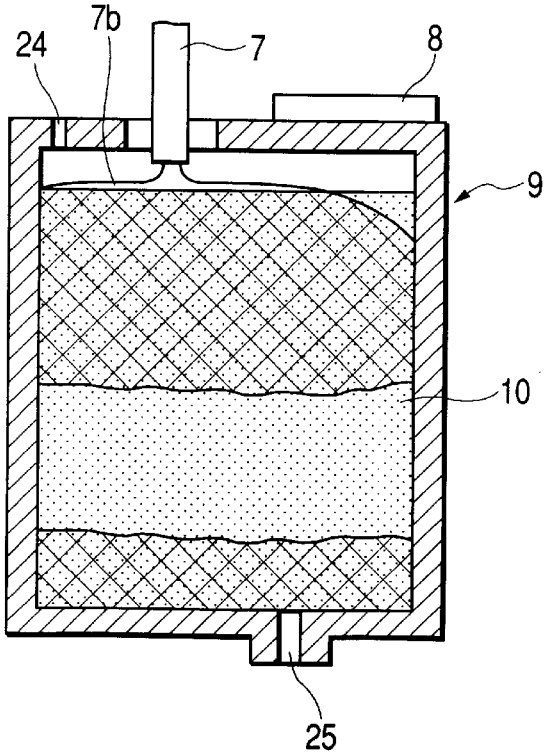
FIG. 7 is a cross-sectional view showing the ink replenishing operation in case the negative pressure generating member in the tank unit is not hydrophilized.

FIG. 7 is a cross-sectional view showing the ink replenishing operation when the negative pressure generating member 10 in the tank unit 9 is not hydrophilically processed. Also in FIG. 7, the ink absorbing area in the negative pressure generating member 10 is represented by hatching. In case the surface of the fibrous body constituting the negative pressure generating member 10 is not hydrophilically processed, the supplied ink requires a longer time, than in the case of the present embodiment, to reach the gas-liquid interface 11 in the negative pressure generating member 10. Also, depending on various conditions, the supplied ink 7*a* may become unable to reach the gas-liquid interface 11 whereby an ink free area may remain in the negative pressure generating member 10, between the upper part and the lower part. In such case an ink path cannot be formed between the upper part and the lower part of the negative pressure generating member 10, whereby results defective ink supply to the recording head. Also if the replenished ink is pressurized in order to accelerate the absorption in the negative pressure generating member 10, the pressurized ink may pass through a gap between the internal wall of the tank unit 9 and the external periphery of the negative pressure generating member 10 and may be forcedly supplied to the recording head through the ink supply aperture 25.

In contrast, in the present embodiment, the ink replenishment to the negative pressure generating member 10 can be executed promptly and securely since the fibers constituting the negative pressure generating member 10 are hydrophilically processed. Consequently there can be realized a highly reliable liquid discharge recording apparatus of pit-in system for executing ink replenishment to the tank unit 9 mounted on the carriage and containing the negative pressure generating member 10.

In the present embodiment, there has been explained a liquid supply system for the ink of a color, among the inks of the aforementioned colors employed in the color printer 111, but the above-described configuration may also be adopted in the liquid supply systems for the inks of respective colors. Thus the color printer 111 may be provided with a plurality of large replenishing tanks with respectively different kinds of liquids and with a plurality of the tank units on the carriage, respectively corresponding to the replenishing tanks of respective colors. Also a fibrous body consisting of fibers is used as the absorbent member contained in the tank unit 9, but there may instead be employed a porous body such as sponge, and, in such case, the porous body is required to be hydrophilically processed in order to promptly absorb the ink.

Additional Explanation on Surface Modifying Method

In the following there will be explained a method for modifying the surface of an article, applicable for the hydrophilic processing of the present invention.

At first there will be given a detailed explanation on the principle of modification, for the surface of an article, that can be applied for rendering hydrophilic the fibers constituting the absorbent member.

The surface modifying method explained in the following is to apply a polymer (or a decomposition product thereof) with a specified orientation to the surface, utilizing for example a functional radical of a molecule contained in a substance constituting the surface of the article, and to provide the surface with a property associated with a radical contained in such polymer (or such decomposition product) thereby achieving the desired surface modification.

In the present text, "article" means an article of a certain external shape, composed of various materials. Therefore, associated with such external shape, there exists an external surface exposed externally. In addition, the article may contain a gap portion, a pore portion, or a hollow portion including a part communicating with the exterior, and an internal surface (internal wall) defining such portions may also constitute a partial surface to be subjected to the surface modification in the present invention. Such hollow portion can also be a hollow space provided with an internal surface defining such space and isolated completely from the exterior, but such hollow space can also be subjected to the processing of the present invention if it accepts the application of surface processing liquid into such space prior to the surface modifying process and becomes a hollow space isolated from the exterior after the surface modifying process.

As explained in the foregoing, the surface modifying method employed in the present invention can to applied, among all the surfaces of various articles, to the surface that can be contacted with the surface processing liquid from the exterior, without affecting the shape of the article. Consequently the external surface of the article and/or the internal surface connected thereto is regarded as the partial surface to be processed. The present invention also includes modification of the property of a divided partial surface selected from such partial surface. Depending on the selection, a mode of selecting the external surface of the article and the internal surface connected thereto is also included in the modification of the desired partial surface area.

In the surface modification mentioned above, there is processed a portion (partial surface) to be modified, constituting at least a part of the surface of the article. Stated differently, there is processed a part, selected according to the desire, of the surface of the article or the entire surface thereof.

Also in the present text, "subdivision of polymer" means any from a cleaved part of the polymer to a monomer, and includes, in embodiments, all the cleaved products of the polymer obtained by a cleaving catalyst such as an acid. Also "polymer film formation" includes formation of a substantial film and different orientations of the portions with respect to a two-dimensional plane.

Also in the present text, "polymer" is provided with a first portion including a functional radical and a second portion having an interfacial energy different from that of the functional radical and approximately equal to the surfacial energy of the surface energy of the article constituting the object of adhesion, and is preferably different from the material constituting the surface of the aforementioned article. Therefore, depending on the material constituting the article to be modified, there can be suitably selected a desired polymer among the polymers having interfacial energies approximately equal to the surfacial energy of the surface of the article. More preferably the "polymer" is cleavable and condensable after cleavage. Also the polymer may be provided with another function radical in addition to the aforementioned first and second portions, but, in such case, for example in case of hydrophilic processing, the hydrophilic radical constituting the functional radical is preferably of a longer chain in comparison with the other functional radical (constituting a hydrophobic radical relative to the aforementioned hydrophilic radical) other than the first and second portions.

Principle of Surface Modification

The surface modification of the article, applicable in the present invention, is achieved by employing a polymer as the surface modifying agent, composed by a main skeleton (collectively including a main chain, a side chain radical and side chain radicals) having an interfacial energy approximately equal to the surfacial (interfacial) energy of the surface of article (substrate surface) and a radical connected thereto and having an interfacial eneregy different from the surfacial (interfacial) energy of the article surface, and adhering the polymer to the article surface by the main skeleton of the surface modifying agent having the interfacial energy approximately equal to that of the article surface thereby causing the radical, having the interfacial energy different from that of the article surface, to form a polymer film (polymer covering) oriented outwards with respect to the article surface.

Stated differently, the aforementiond polymer to be used as the surface modifying agent can be considered to have a second radical basically different in affinity to water from the radicals exposed on the article surface prior to the surface modification, and a first radical substantially similar in affinity to water to the radicals exposed on the article surface and contained in the repeating unit in the main skeleton.

Figure 8A:
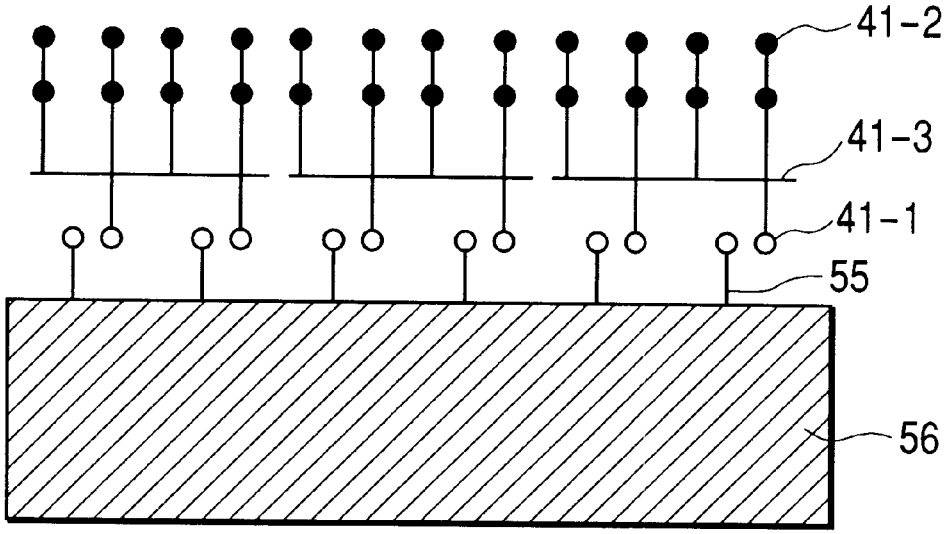
Figure 8B:
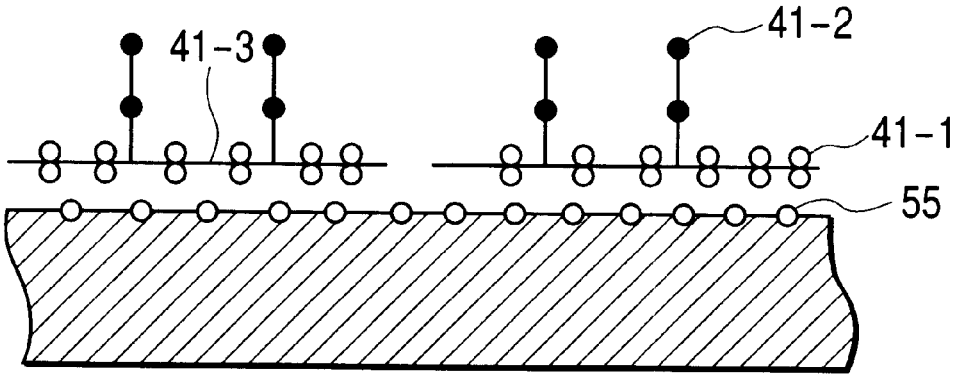

FIGS. 8A and 8B show a representative example of such orientation, wherein FIG. 8A shows a case of employing a polymer in which a first radical 41-1 and a second radical 41-2 are combined as side chains to a main chain 41-3, while FIG. 8B shows a case where a second radical 41-2 constitutes a main chain 41-3 itself and a first radical 41-1 constitutes a side chain.

In the orientation shown in FIGS. 8A and 8B, at the outerkmost surface of the substrate 56 constituting the surface to be modified of the article, there are oriented the radicals 41-1 having an interfacial energy different from the surfacial (interfacial) energy of the substrate 56, so that the surface is modified by the property associated with such radicals 41-1 having the interfacial energy different from the surfacial (interfacial) energy of the substrate 56. The surfacial (interfacial) energy of the substrate 56 is determined by surfacially exposed radicals 55 of the substance or molecules constituting the surface.

Thus, in the example shown in FIGS. 8A and 8B, the first radical 41-1 serves as the functional radical for surface modification, and, if the surface of the substrate 56 is hydrophobic and the first radical 41-1 is hydrophilic, the hydrophilicity is given to the surface of the substrate 56. Also in case the first radical 41-1 is hydrophilic and the radical 55 of the substrate 56 is hydrophobic, a state as shown in FIG. 28 is assumed to be present on the surface of the substrate 56 for example when there is employed for example polysiloxane to be explained later.

In such state, it is also possible, by adjusting the balance of the hydrophilic radicals and the hydrophobic radicals on the surface of the substrate 56 after surface modification, to regulate the flow or flow speed of water or aqueous liquid principally composed of water in case of passing water or such liquid through the surface of the substrate after surface modification. Also by employing a fibrous body consisting for example of polyolefinic fibers having such surface state at the external wall of the fiber in the ink tank integrated in the ink jet recording head or formed as a separate member, it is rendered possible to extremely effectively achieve ink filling into the ink tank and ink supply from the ink tank to the recording head, and to secure an appropriate negative pressure in the ink tank, thereby maintaining a satisfactory ink interface (meniscus) in the vicinity of the discharge port of the recording head immediately after the ink discharge.

In this manner there can be provided a most suitable negative pressure generating member showing the static negative pressure larger than the dynamic negative pressure, in holding the ink to be supplied to the ink jet recording head.

Figure 28:
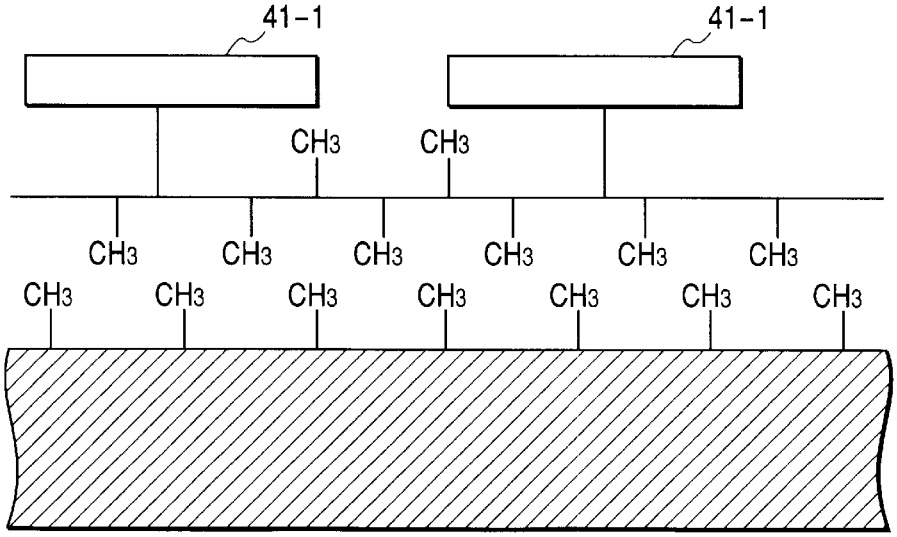
FIG. 28 is a view schematically showing an example of the estimated distribution of hydrophilic radicals and hydrophobic radicals on the surface processed by the surface modifying process applicable to the present invention.

Particularly in the fiber having the surface structure shown in FIG. 28, the hydrophilic radical 41-1, being a polymer radical, is longer than methyl radical (hydrophobic radical) constituting the side chain of the same side. Therefore, at the ink flow, the hydrdophilic radicals 41-1 are inclined in the direction of such flow and along the fiber surface (at the same time substantially coverting the methyl radicals). As a result, the flow resistance is significantly reduced. On the other hand, in case the ink is stopped and forms a meniscus between the fibers, the hydrophilic radicals 41-1 are aligned toward the ink, namely perpendicularly to the fiber surface (thus exposing the methyl radicals on the fiber surface), thereby balancing the hydrophilicity (large) and the hydrophobicity (small) in the intramolecular level, thus generating a sufficient negative pressure. The aforementioned function of the hydrophilic radical 41-1 is preferably secured by constituting, as in the foregoing embodiment, the hydrophilic radical 41-1 with a plurality of (—C—O—C—) bonds and a terminal OH radical and by providing the polymer with a large number of (at least plural) hydrophilic radicals. Also in case the polymer is provided with a hydrophobic radical other than the aforementioned methyl radical, the hydrophilic radical is preferably of a larger molecular level in order that the area of presence of the hydrophilic radicals is larger than that of the hydrophobic radicals, and there is required the aforementioned balance that the hydrophilicity is larger than the hydrophobicity.

The static negative pressure at the ink supply aperture is represented by the following relation:

static negative pressure=(height from the ink supply aperture to the ink interface)−(capillary force of fibers at the ink interface)

The capillary force is proportional to $\cos\theta$, wherein $\theta$ is the wetting contact angle between the ink and the fibrous absorbent member. It is therefore possible, by the hydrophilic processing of the present invention, to secure a lower static negative pressure, or a higher pressure in the absolute value for the ink showing a large variation in $\cos\theta$.

More specifically, if the contact angle is in the order of 10°, the hydrophilic processing provides an increase in the capillary force of about 2% at maximum, but, in case of a not easily wettable combination of the ink and the fiber for example having a contact angle of 50°, a reduction of the contact angle for example to 10° by the hydrophilic processing corresponds to an increase of the capillary force by 50% ($\cos 0°/\cos 10° \approx 1.02$, $\cos 10°/\cos 50° \approx 1.5$).

As a specific method for producing the article with the modified surface shown in FIG. 8, there will be explained a method of employing an improving agent which is a good solvent for the polymer employed for surface modification and improves the wetting property of the processing agent for the substrate. This method consists of coating processing liquid (surface modifying solution), in which the surface modifying polymer is uniformly dissolved, on the substrate surface and orienting the surface modifying polymer in the above-described manner while the solvent contained in the processing liquid is removed.

More specifically, liquid (surface processing liquid, preferably containing purified water in case the functional radical is a hydrophilic radical) is prepared by mixing the polymer of predetermined amount and a cleaving catalyst in a solvent which is a rich solvent to the polymer and is capable of sufficiently wetting the substrate surface and is coated on the substrate surface, there is executed a step of drying by evaporation (for example in an oven of 60° C.) in order to remove the solvent in the surface processing liquid.

In such solvent, the presence of an organic solvent capable of sufficiently wetting the substrate surface and dissolving the surface modifying polymer is preferred in order to facilitate uniform coating of the surface modifying polymer. Such organic solvent also provides an advantage that the surface modifying polymer can be uniformly dispersed within the coated liquid layer and can maintain a sufficiently dissolved state even when the concentration thereof becomes elevated by the evaporation of the solvent. Furthermore, the surface modifying polymer can be uniformly spread over the substrate surface since the surface processing liquid can sufficiently wet the substrate surface, whereby the polymer covering can be uniformly achieved even on a surface of a complex shape.

Also in the surface processing liquid, there may be employed, in addition to a volatile first solvent which is capable of wetting the substrate surface and is a rich solvent to the polymer, a second solvent which is a rich solvent for the polymer but has a lower wetting property on the substrate surface and a lower volatility in comparison with the first solvent. As an example of such composition, there can be employed a combination of isopropyl alcohol and water to be explained later, in case the substrate surface is composed of polyolefinic resin and the polymer is composed of polyoxyalkylene-polydimethylsiloxane.

In the surface processing liquid, an acid may be added as the cleaving catalyst in order to obtain the following effects. For example, when the concentration of the acid component is elevated by the evaporation of the solvent in the course of drying of the surface processing liquid by evaporation, such acid of high concentration under heating induces partial decomposition (cleavage) of the surface modifying polymer and generation of decomposition products of the polymer, thereby enabling orientation in finer portions on the substrate surface. Also in the final stage of drying by evaporation, the cleaved portions of the polymer mutually recombine to effect polymerization of the surface modifying polymers, thereby accelerating the formation of the polymer film (polymer covering, preferably a monomolecular film).

Also, when the concentration of the acid component is elevated by the evaporation of the solvent in the course of drying of the surface processing liquid by evaporation, there can be expected an effect of forming a clean substrate surface as such acid of high concentration eliminates impurities on the substrate surface and in the vicinity thereof. On such clean surface, there can be expected an improvement in the physical adhesion force between the substance or molecules of the substrate and the surface modifying polymer.

In such case, there is also assumed a case where the substrate surface is decomposed by the acid of high concentration under heating to generate an active point on the substrate surface, and such active point and the subdivision product resulting from the aforementioned cleavage of the polymer are coupled by an auxiliary chemical reaction. Also in certain case, there may locally exist an improved stabilization of adhesion of the surface modifying agent on the substrate, by such auxiliary chemisorption between the surface modifying agent and the substrate.

In the following there will be explained a polymer film forming process based on the cleavage of the main skeleton of the surface modifying agent (including hydrophilic processing liquid) having a surfacial energy approximately equal to that of the substrate and the condensation of the cleaved products on the substrate surface, with reference to FIGS. 9 to 15, taking an example where the functional radical is a hydrophilic radical and the hydrophilicity is provided to a hydrophobic substrate surface. The hydrophilic radical mentioned above means a structure capable of providing the hydrophilicity in the entire radical, and includes not only a hydrophilic radical itself but also a structure capable of serving as a radical for providing the hydrophilicity, even if it contains a hydrophobic chain or a hydrophobic radical, for example by substitution with a hydrophilic radical.

Figure 9:
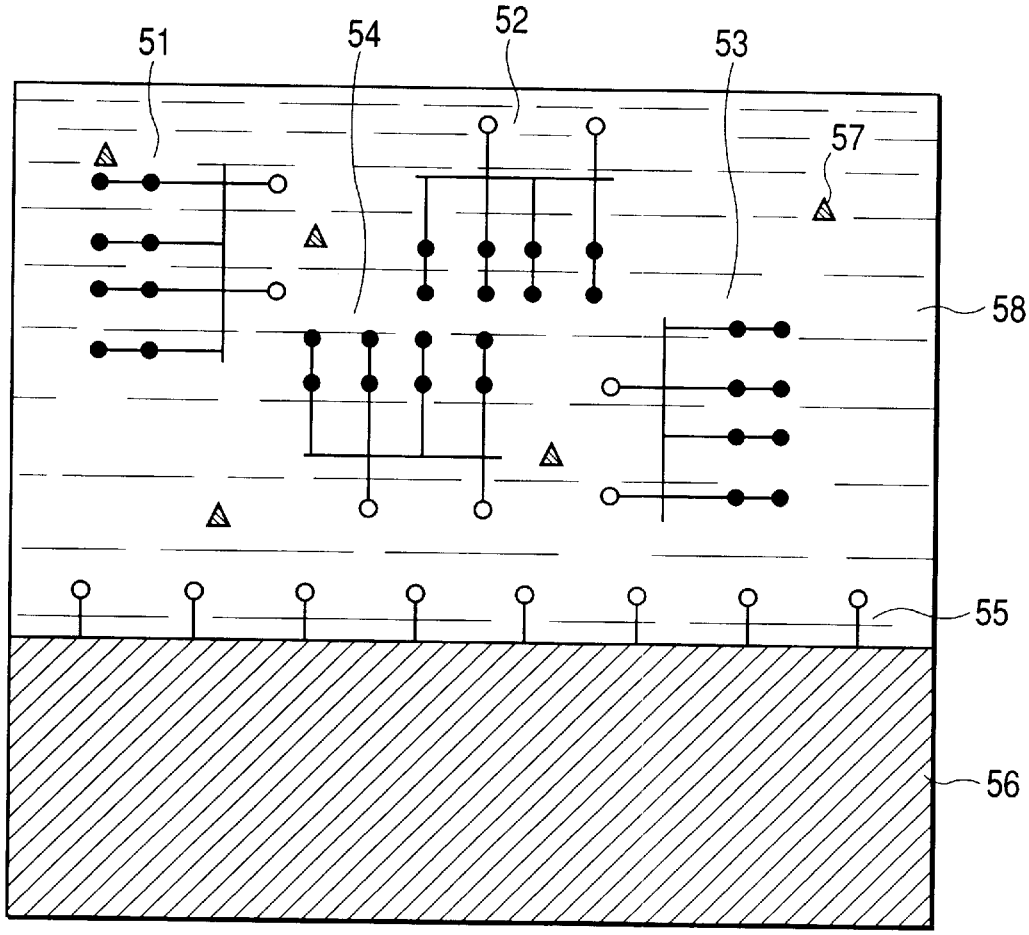
FIG. 9 is a view schematically showing, in a surface modifying method employable in the present invention, a state where a coated layer is formed on a substrate by coating processing liquid containing the surface modifying agent.
Figure 10:
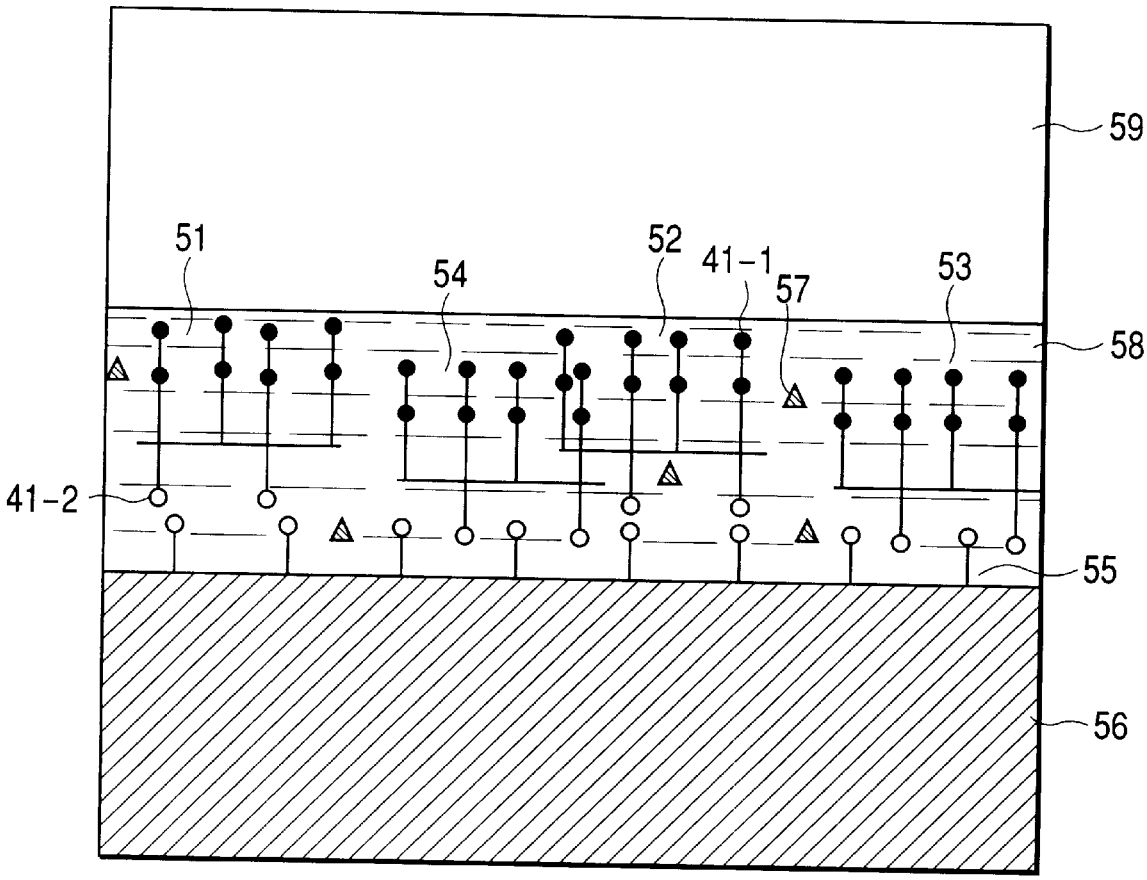
FIG. 10 is a view showing, in a surface modifying method employable in the present invention, a step of partially eliminating the solvent in the coated layer formed on the substrate and containing the mer of surface modifying agent.

FIG. 9 is a magnified view showing the state after coating of the hydrophilic processing liquid. In this state, hydrophilic processing polymers 51 to 54 and an acid 57 in the hydrophilic processing liquid 58 are uniformly dissolved therein on the surface of a substrate 56. FIG. 10 is a magnified view of a drying step after coating of the hydrophilic processing liquid. In such drying step under heating, an increase in the concentration of the acid component resulting from the evaporation of solvent achieves elimination of impurities on the surface of the substrate 56 and in the vicinity thereof, thereby cleaning such surface and forming a pure surface of the substrate 56, whereby the physical absorption force of the surface modifying polymers 51 to 54 to the substrate 56 is increased. Also in the drying step under heating after coating of the hydrophilic processing liquid, the increase in the concentration of the acid concentration resulting from the evaporation of the solvent may also cause cleavage of a part of the hydrophilic processing polymers 51 to 54.

Figure 11:
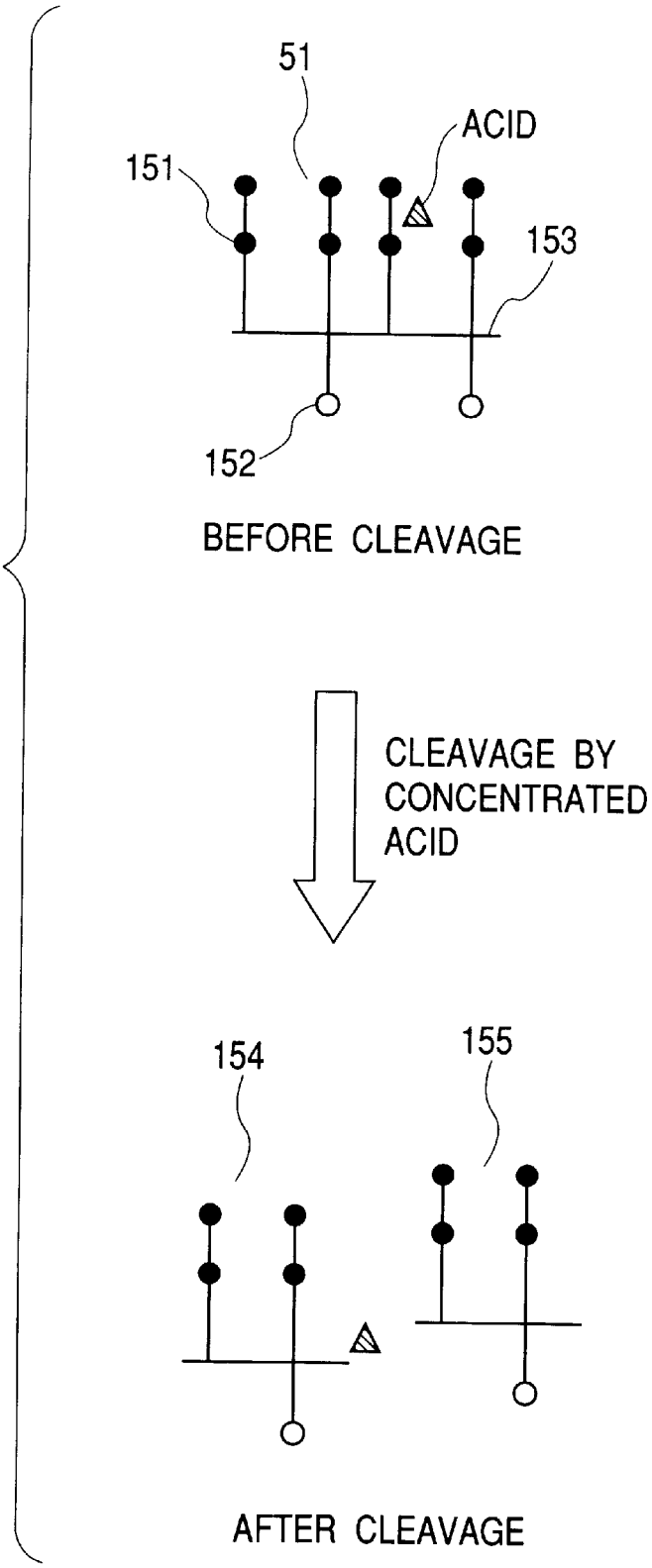
FIG. 11 is a view showing a step of partial cleavage of polymer of the surface modifying agent, associated with the step of partially eliminating the solvent in the coated layer containing the polymer of surface modifying agent and induced by an acid added in the processing liquid.
Figure 12:
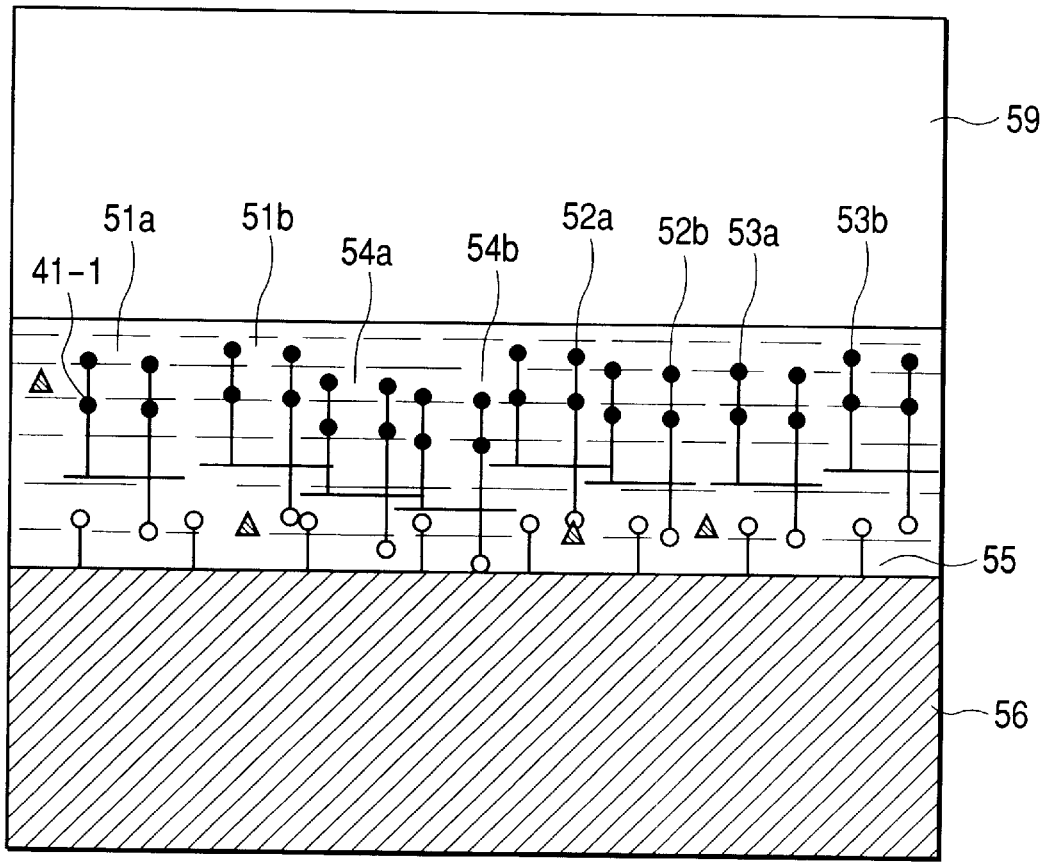
FIG. 12 is a view showing a step of orienting the polymer of surface modifying agent or a cleaved product thereof, associated with a step of further eliminating the solvent in the coated layer containing the polymer of surface modifying agent.

FIGS. 11A and 11B schematically shows the decomposition of the polymer 51 by a concentrated acid, and FIG. 12 shows absorption of thus decomposed hydrophilic processing agent to the substrate. Then, with further progress of evaporation of the solvent, the main skeleton portions, having a surfacial energy approximately equal to that of the substrate, of the subdivided elements 51*a* to 54*b* derived from the hydrophilic processing polymer which has reached the saturated state are selectively absorbed to the pure surface of the substrate 56 formed by cleaning. As a result, radicals 41-2, having a surfacial energy different from that of the substrate 56, in the surface modifying agent are oriented outwards with respect to the substrate 56. In FIG. 11, there are shown a first radical 151, a second radical 152, a main chain 153 of the surface modifying agent, a subdivided element-1 154 and a subdivided element-2 155.

Figure 13:
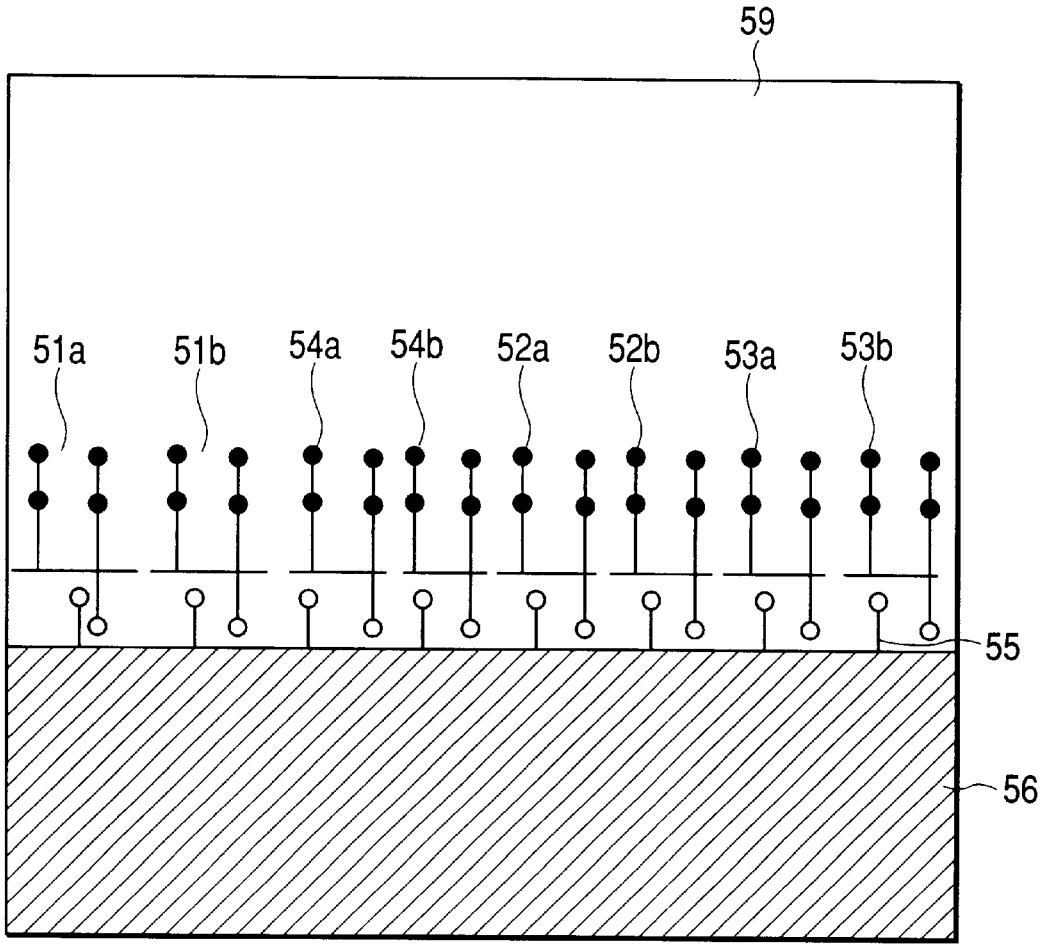
FIG. 13 is a view showing a step of eliminating the solvent of surface modifying agent by drying whereby the polymer of surface modifying agent or the cleaved product thereof is oriented and adhered to the surface.

Consequently, on the surface of the substrate 56 there are oriented the main skeleton portions having an interfacial energy approximately equal to the surfacial (interfacial) energy of such surface while the radicals 41-2 having a surfacial energy different from that of the substrate 56 are oriented at the outside opposite to the surface of the substrate 56, whereby hydrophilicity is given to the surface of the substrate in case the radicals 41-2 are hydrophilic radicals, thus achieving surface modification. FIG. 13 schematically shows the absorption state of the hydrophilic processing agent on the substrate surface after coating and drying of the hydrophilic processing liquid.

Figure 14:
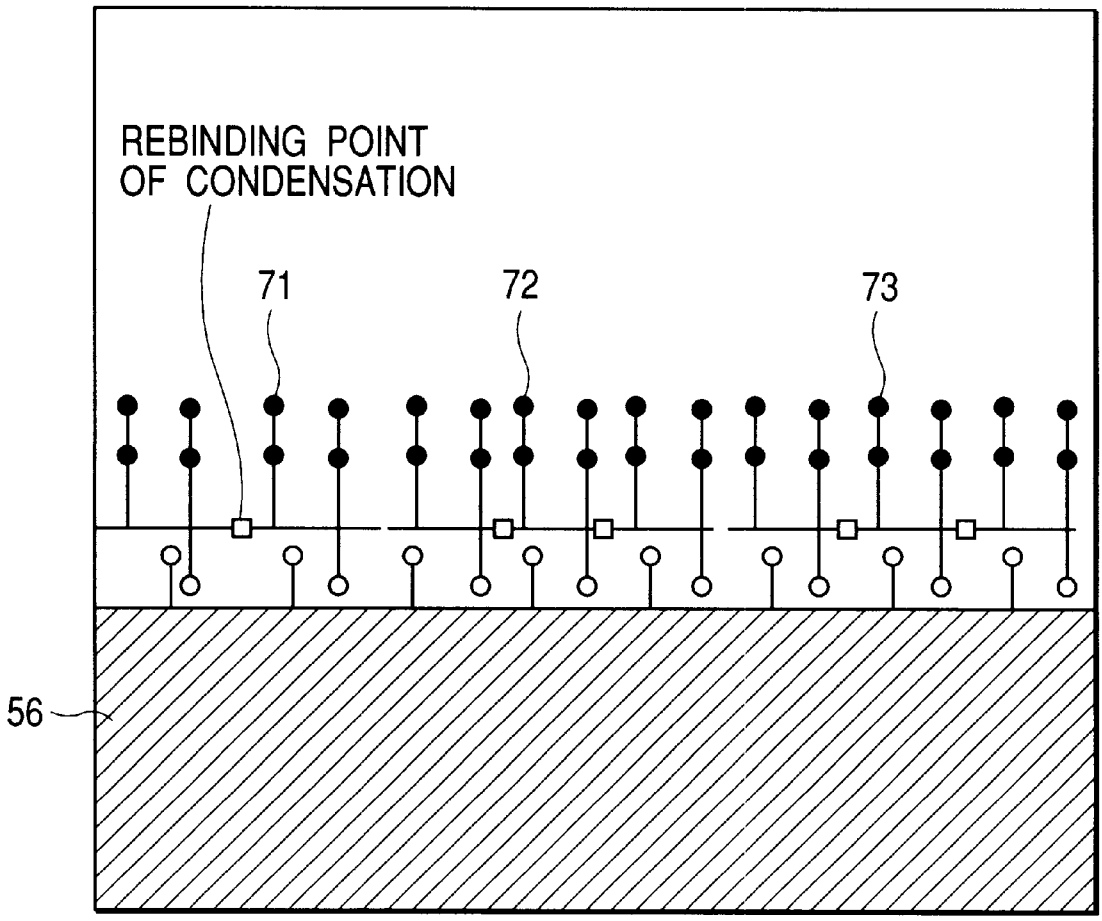
FIG. 14 is a view showing a step in which the cleaved products derived from the polymer of surface modifying agent adhered to the surface mutually recombine by a condensation reaction.

It is also possible to employ a polymer such as polysiloxane of which cleaved products can combine in at least a part of such cleaved products for example by condensation, thereby forming a polymer by coupling of the subdivided elements absorbed on the surface of the substrate 56 and reinforcing the film of the hydrophilic processing agent. FIG. 14 schematically shows the recombination by such condensation reaction, namely the combined state of condensed polymers 71 to 73. The formation of the subdivided elements by cleavage and the polymerization by condensation of such subdivided elements have the following mechanism in case of polysiloxane.

The controlled drying of the surface processing liquid on the processed surface elevates the centration of a dilute acid contained in such surface processing liquid to generate a concentrated acid (for example $H_2SO_4$), which cleaves the siloxane bonding of polysiloxane to generate subdivided elements of polysiloxane and silyl sulfuric acid (scheme 1). Then, with further drying of the processing liquid on the processed surface, there also increases the concentration of the subdivided elements present in the surface processing liquid, thereby elevating the probability of mutual contact of the subdivided elements. As a result, the subdivided elements mutually cause condensation to regenerate the siloxane bonding, as shown in the scheme 2. Also in case the processed surface is hydrophobic, the methyl radical of the by-produced silyl sulfuric acid is oriented toward the processed surface, while the sulfon radical is oriented in a direction different from the processed surface, thereby contributing to a certain extent to the hydrophilic processing of the processed surface.

Scheme 1

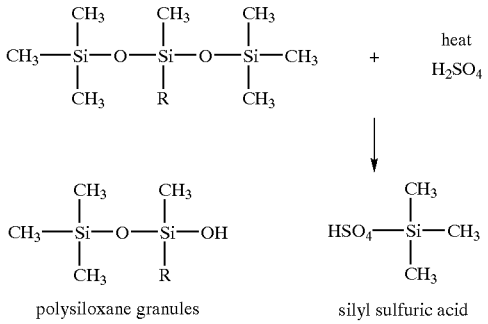

Scheme 2

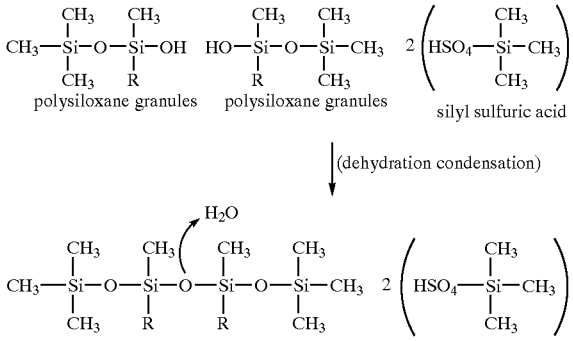

Figure 15:
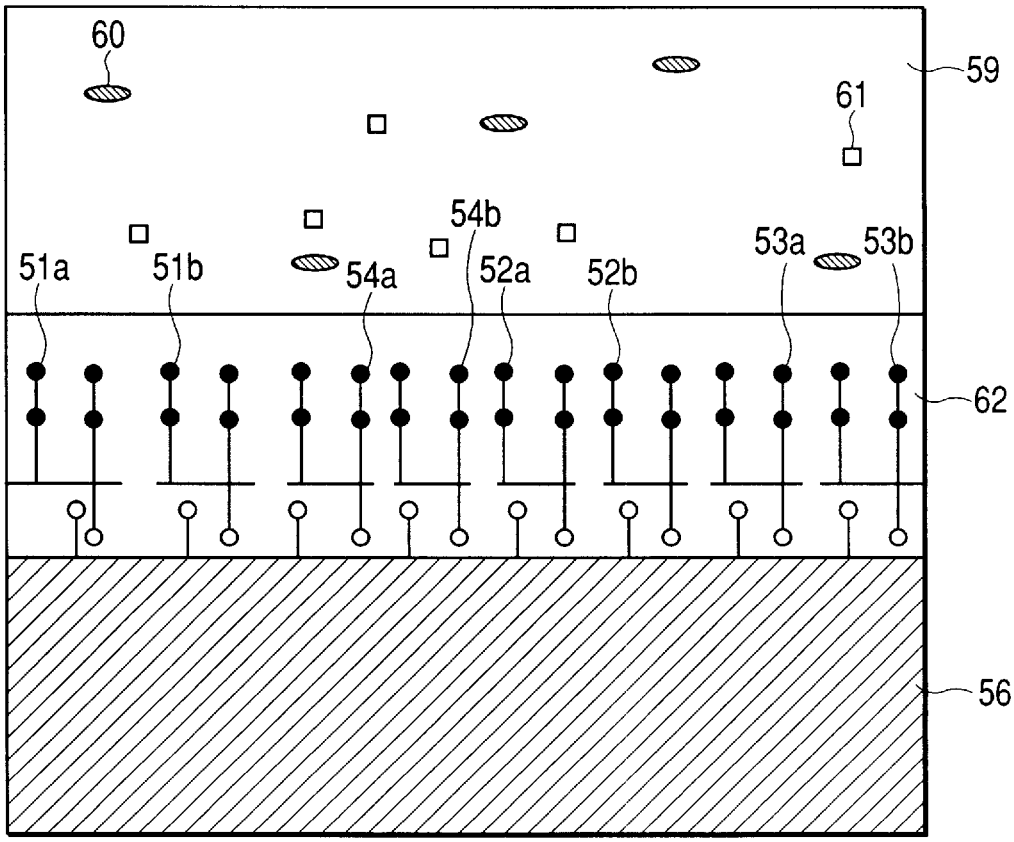
FIG. 15 is a view showing a case of applying the surface modifying method, employable in the present invention, to the hydrophilic processing of a water-repellent surface and showing the effect of adding water in the processing liquid.

Also FIG. 15 schematically shows an example of the state of the surface processing liquid in case the solvent thereof contains water. In case the solvent of the processing liquid contains water, water and volatile organic solvent evaporate (gaseour molecule of water and that of organic solvent being respectively indicated by 61 and 60) in the course of solvent evaporation from the processing liquid for hydrophilic processing under heating. In such operation, since the volatile organic solvent evaporates faster than water, the concentration of water is elevated in the processing liquid, thereby elevating the surface tension thereof. As a result, there results a difference in the surfacial energy at the interface between the processed surface of the substrate 56 and the processing liquid whereby, at such interface between the processed surface of the substrate 56 and the processing liquid (water containing layer 62) in which the water concentration is elevated by evaporation, the portions of the subdivided elements 51*a* to 54*b*, having a surfacial energy approximately equal to that of the processed surface of the substrate 56, derived from the hydrophilic processing polymer are oriented toward the processed surface of the substrate 56. On the other hand, the portions having hydrophilic radicals in the subdivided elements derived from the hydrophilic processing polymer are oriented toward the water containing layer 62 in which the water concentration is elevated by evaporation of the organic solvent. As a result, it is estimated that the orientability of the subdivided elements of the polymer can be more increased.

The present invention relates to a fibrous absorbent body capable of maintaining ink by a negative pressure and adapted for application to the ink jet system, and is featured by applying a hydrophilic processing to the surface of the fibers constituting such fibrous absorbent body, but the aforementioned surface modification for the article employable in the present invention is applicable not only to the fibers but also to various articles and purposes according to the characteristics and kind of the functional radical provided in the polymer. In the following there will be explained certain examples.

(1) In Case the Functional Radical is a Hydrophilic Radical:

In an article requiring absorbability for example in the ink absorbent member to be used in the ink jet system (the foregoing embodiment being applicable in case the member contains olefinic fibers), the surface modification of the present invention can provide hydrophilicity capable of instantaneously absorbing liquid (for example aqueous ink explained in the foregoing embodiments). It is also effective in case a liquid retaining property is required.

(2) In Case the Functional Radical is an Oleophilic Radical:

The surface modification of the present invention can effectively provide any article requiring oleophilicity with such property.

(3) The Surface Modification is Applicable to any Other Application Achievable by the Mechanism of the Aforementioned Principle, and such Applications are also Included in the Present Principle.

The aforementioned surface modification based on condensation after cleavage exhibits particularly excellent effect, securely with uniformity and characteristics not achievable in the conventional technologies, by employing, as the processing agent, a wetting improving agent capable of achieving wetting of the article surface and serving as the medium for the polymer (for example isopropyl alcohol: IPA), a medium inducing cleavage of the polymer, and a polymer provided with any of the aforementioned functional radicals and a radical (or radicals) having an interfacial energy different from that of such functional radical and approximately same to the partial surfacial energy of the article.

In the present text, a property excellent in wetting to the contained liquid is called "lyophilicity".

Also the fibers may contain a neutralizer (calcium stearate or hydrosulfite) or other additives employed in molding or formation of the fibers, but, as an auxiliary concept of the present invention, the aforementioned surface modification allows to reduce the dissolution of these substances into the ink or precipitation thereof by the ink, and the polymer film of the present invention can thus resolve such drawbacks. Therefore the aforementioned surface modification allows to expand the range of use of the additives such as neutralizer, to prevent the change in the characteristics of the ink itself, and also to prevent the change in the characteristics of the ink jet head itself.

Figure 27:
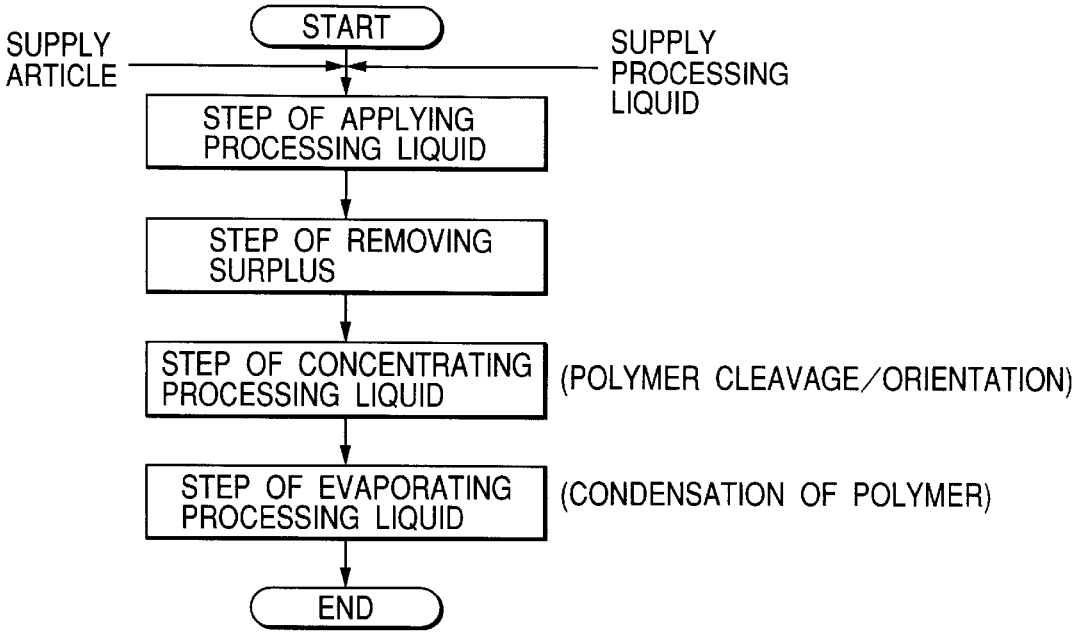
FIG. 27 is a flow chart showing an example of the surface modifying process applicable to the present invention.

FIG. 27 shows an example of the process flow in the manufacture of these articles. At the start of manufacture, there are provided an article and processing liquid, and an article with a modified surface can be obtained through a step of applying the processing liquid to the surface to be modified (processed surface) of the article, a step of eliminating the surplus from the processed surface, a step of concentrating the processing liquid by evaporation for inducing polymer cleavage on the processed surface and for orientation of the subdivided elements, and a step of polymer condensation for coupling the subdivided elements thereby forming a polymer.

The processing liquid condensing step and the processing liquid evaporating step can be executed by a continuous heating and drying step preferably at a temperature higher than the room temperature and not exceeding the boiling point of the solvent (for example 60° C. Such process can be executed for example in a period of about 45 minutes to 2 hours in case of employing polysiloxane, together with water, acid and organic solvent (for example isopropyl alcohol) in order to modify the surface consisting of polyolefinic resin, and requires for example about 2 hours in case of employing aqueous solution of isopropyl alcohol of 40 wt. % Such drying process time can be reduced by decreasing the water content.

In the example shown in FIG. 27, the formation of the subdivided elements by cleavage of the polymer is executed on the processed surface of the article, but it is also possible to feed processing liquid, already containing the subdivided elements, onto the processed surface of the article, thereby inducing orientation.

The processing liquid can be composed, as explained in the foregoing, of a wetting improving agent having a wetting property to the processed surface in order to improve the wetting of the processed surface by the processing liquid and constituting a rich solvent for the polymer which is an effective component of the surface modifying agent, a solvent, a polymer cleaving catalyst, and a polymer provided with a functional radical for providing the processed surface with a modifying effect and a radical for obtaining an adhering property to the processed surface.

Principle Applied Example 1

Figure 16A:
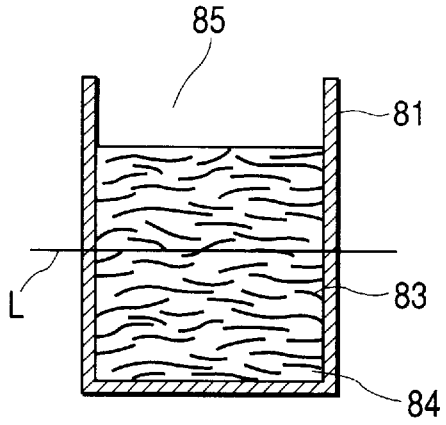

In the following there will be explained an example of applying the aforementioned principle of hydrophilic surface processing to a polypropylene-polyethylene fibrous body. The actual polypropylene-polyethylene fibrous body assumes the shape of a block obtained by complexing fibers and usable as an ink absorbent member for impregnating with ink and retaining ink therein. For example, as shown in FIG. 16A, a container 81 of a suitable shape having an aperture 85 open to the external air may be used as a liquid container by incorporating therein, in a predetermined orientation, a fibrous body 83 serving as the absorbent member for various liquids such as ink. Such ink absorbent member can be advantageously utilized in an ink tank to be employed in an ink jet recording apparatus. In particular, as will be explained later with reference to FIGS. 18A to 18C, 19A to 19C, in case of incorporating the fibrous body into the tank after the fibrous absorbent body impregnated with the hydrophilic processing liquid is compressed to squeeze off the surplus processing liquid from the gaps of the fibers and is then subjected to drying by heating, the squeezing direction for eliminating the processing liquid preferably coincides with the direction of compressing the fibrous absorbent body at the insertion into the tank. This is because, even if the hydrophilic processing agent is not securely adhered for example to the branched portions of the fibers when the fibrous absorbent body compressed at the processing liquid squeezing operation restores the original form, such defects can be compensated at the insertion of the fibrous absorbent body into the tank.

More specifically, the fibers are composed of polypropylene-polyethylene biaxial fiber members, and each fiber has a length of about 60 mm. Such fiber member has a cross-sectional shape shown in FIG. 17A with a substantially circular (annular) external shape in a cross section perpendicular to the axis, and is composed of a core member of polypropylene fiber of a relatively higher melting point and a sheath member of polyethylene of a relatively lower melting point therearound. A fiber block consisting of short fibers of such sectional structure is subjected to fiber alignment by a combing machine and is then heated to induce fusion between the fibers. More specifically, heating is executed at a temperature higher than the melting point of polyethylene but lower than that of polypropylene constituting the core member, thereby obtaining a structured member in which the sheath members of polyethylene mutually fuse at the mutually contacting points of the fibers.

Figure 16B:
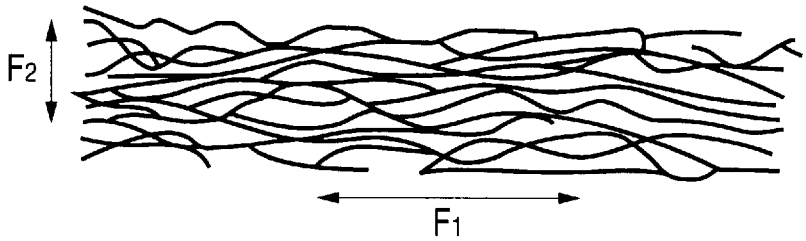
Figure 16C:
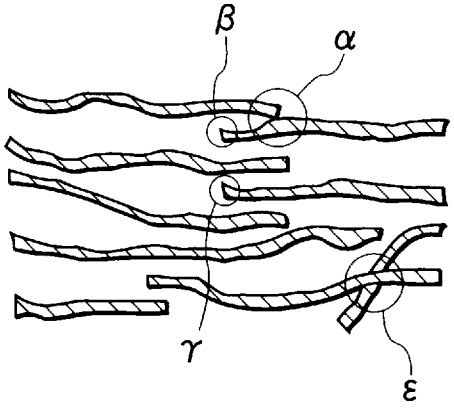
Figure 16D:
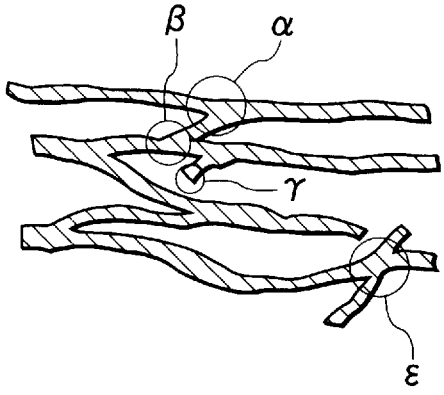

In the aforementioned structured fiber body, the fibers are principally alined continuously in the longitudinal direction F1 as shown in FIG. 16C because of the fiber alignment by the combing machine, and are mutually contacted locally. The heating induces mutual fusion at such contacting points to constitute a network structure showing mechanical elasticity in a perpendicular direction F2. As a result, the tensile strength is elevated in the longitudinal direction F1 shown in FIG. 16B, and, in the perpendicular direction F2, there is obtained an elastic structure showing restoring ability to a compressing deformation, though the tensile strength is low.

Figure 17A:
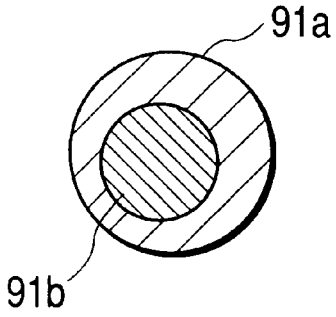

In more detail, each fiber in the structured fiber body is crimpled as shown in FIG. 16C, resulting in a complex network structure by the neighboring fibers with fusions therebetween. Also a part of the crimpled fibers is directed in the perpendicular direction F2 to attain three-dimensional fused structure. The structured fiber body employed in the present example was formed as a sliver from the biaxial fibers consisting of a core member of polypropylene fiber of a melting point of about 180° C. covered by polyethylene of a melting point of about 132° C. in a substantially concentric manner as shown in FIG. 17A. Since such structured fibrous body has a principally orienting direction F1 of the fibers, the fluidity of the liquid impregnated therein and the retaining thereof in a static state are evidently different in the fiber orienting direction F1 and the perpendicular direction F2.

In the present example, since the object article is a structured fibrous body which has a generally higher liquid retaining property than in an article with a flat surface, there was employed processing liquid of the following composition.

TABLE 1

| Composition of hydrophilic processing liquid for fibrous body | |
|---|---|
| Component | Composition (wt. %) |
| (polyoxyalkylene)-poly(dimethyl-siloxane | 0.40 |
| Sulfuric acid | 0.05 |
| isopropyl alcohol | 99.55 |

(1) Hydrophilic Processing for PP-PE Fibrous Absorbent Body

Figure 18A:
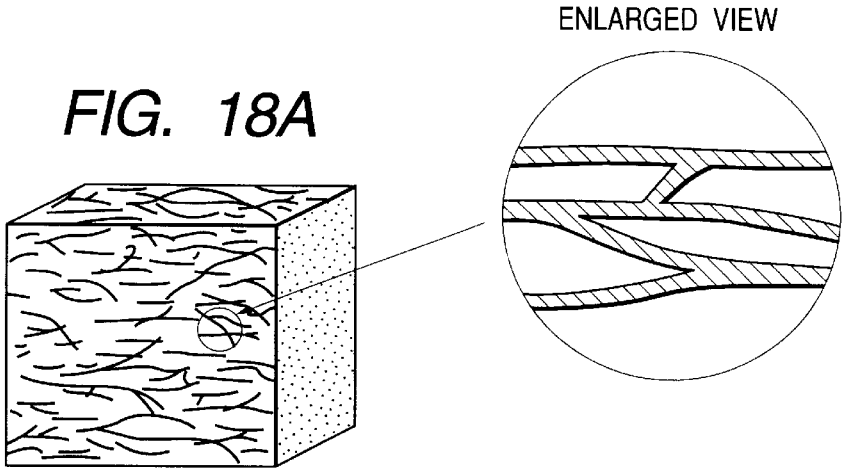
Figure 18B:
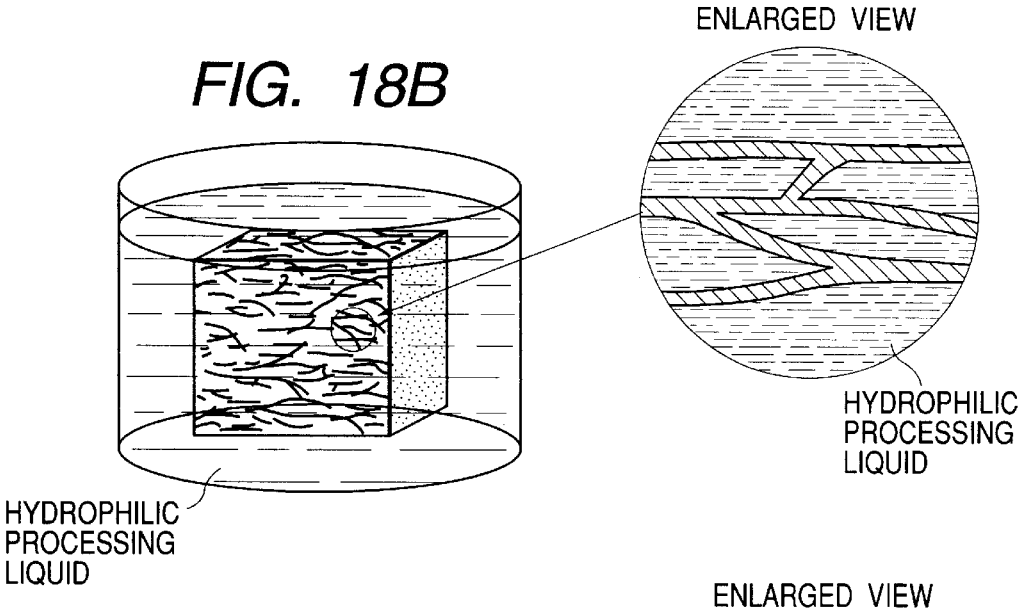
Figure 18C:
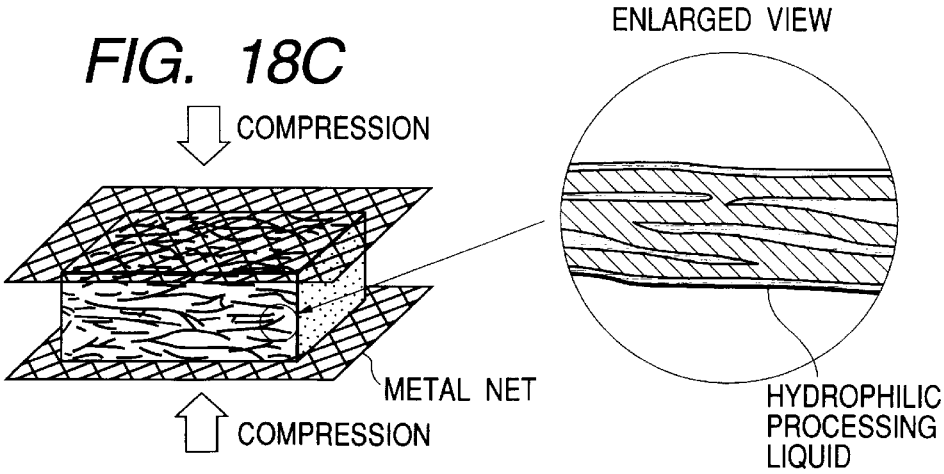
Figure 19A:
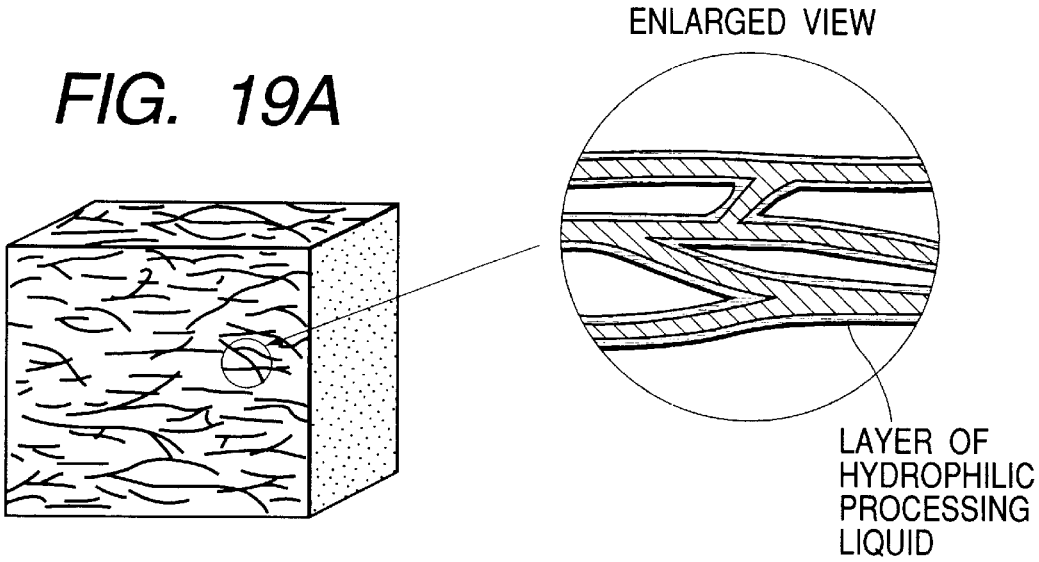
Figure 19B:
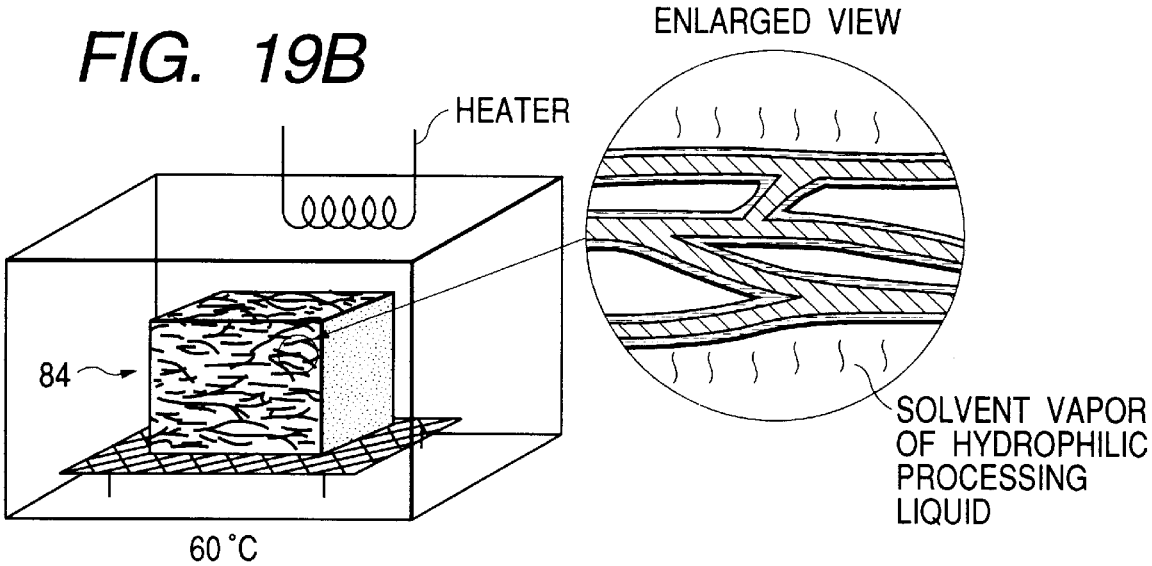

A polypropylene-polyethylene fibrous absorbent member of the structure shown in FIG. 18A was immersed in the hydrophilic processing liquid of the above-mentioned composition (FIG. 18B). In this state, the processing liquid is retained in the gaps in the fibrous absorbent body. Thereafter the fibrous absorbent body was pressed (FIG. 18C) to eliminate the surplus processing liquid retained in the gaps of the fibers. When taken out from a pressing jig such as a metal net, the fibrous absorbent body restores the original shape (FIG. 19A) in which a liquid layer was coated on the surface of the fiber. The absorbent body with the fiber surface wetted with the liquid was dried for 1 hour in an oven of 60° C. (FIG. 19B).

Comparative Example 1 and Reference Example 1

In addition to the foregoing, a hydrophilic processing liquid containing sulfuric acid and isopropyl alcohol only was processed in the same manner as shown in FIGS. 18A to 18C, 19A to 19C, as a comparative example 1. Stated differently there was employed liquid excluding (polyoxyalkylene)-poly(dimethylsiloxane) from the composition shown in Table 1. Also a unprocessed PP-PE fibrous absorbent body was used as a reference example 1.

In the foregoing principle applied example 1, with respect to the PP-PE fibrous absorbent body of 0.5 g, the amount of the hydrophilic processing liquid coated on the entire fibrous absorbent body by the aforementioned coating method was 0.3 to 0.5 g. The coated liquid amount was same also in the comparative example 1.

The surface processed state in each of the fibrous absorbent bodies obtained in the above-described procedure was evaluated in the following manner:

(1) Method for Evaluating Hydrophilicity of PP-PE Fibrous Absorbent Body i) Evaluation by Dripping Purified Water from Squirt Purified water was dropped from a squirt respectively from above the PP-PE fibrous absorbent body processed in the principle applied example 1, that of the comparative example 1 and the unprocessed PP-PE fibrous absorbent body of the reference example and the penetration of purified water was observed.

ii) Evaluation by Immersion in Purified Water

Purified water was filled in a container of a size capable of sufficiently accommodating the PP-PE fibrous absorbent body, then each of the PP-PE fibrous absorbent body processed,in the principle applied example 1, that of the comparative example 1 and the unprocessed PP-PE fibrous absorbent body of the reference example was gently placed in the container and the penetration of purified water into each fibrous absorbent body was observed.

(2) Result of Evaluation of Hydrophilicity of PP-PE Fibrous Absorbent Body i) Result of Evaluation by Dripping Purified Water from Squirt In the PP-PE fibrous absorbent body processed in the principle applied example 1, the purified water dropped from the squirt penetrated instantaneously into the interior of the absorbent body.

On the other hand, in the PP-PE fibrous absorbent body of the comparative example 1 and the unprocessed PP-PE fibrous absorbent body of the reference example 1, the purified water dropped from the squirt did not penetrate into the absorbent body but was repelled thereby, thus forming a spherical liquid drop thereon.

ii) Result of Evaluation by Immersion in Purified Water

The PP-PE fibrous absorbent body processed in the principle applied example 1, when gently placed in the container containing purified water, slowly sank into the purified water. This result indicates that the surface of the PP-PE fibrous absorbent body processed in the process shown in FIGS. 18A to 18C, 19A to 19C at least has hydrophilicity.

On the other hand, the PP-PE fibrous absorbent body of the comparative example 1 or the unprocessed PP-PE fibrous absorbent body, when gently placed in the container containing purified water, floated completely on the purified water, and did not absorb water at all thereafter, clearly indicating water repellency.

Figure 19C:
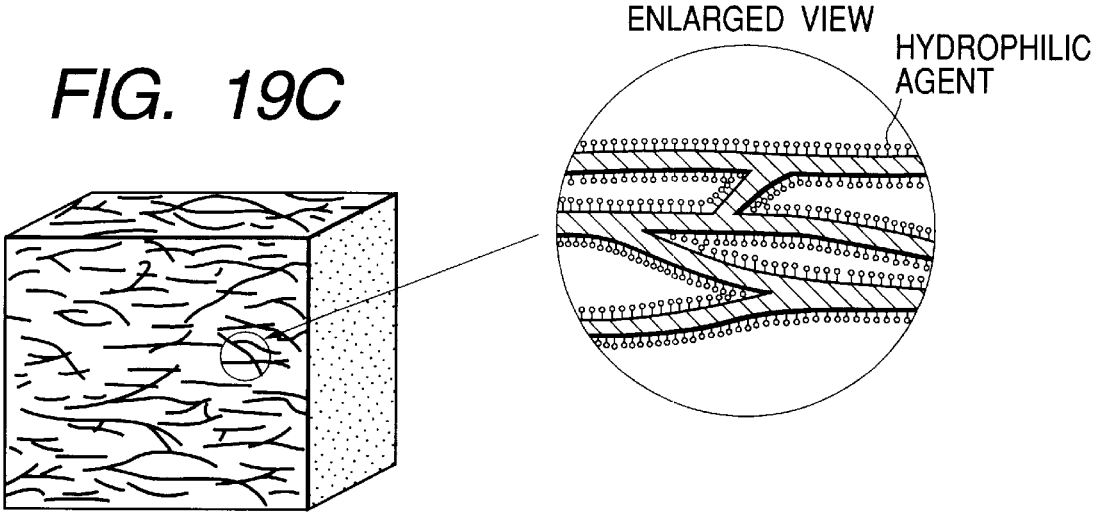

Based on these results, it is judged that, on the PP-PE fibrous absorbent body, the coating and drying of processing liquid containing polyalkylsiloxane with a polyalkylene oxide chain, an acid and an alcohol can form a polyalkylsiloxane coating as shown in FIG. 19C, thereby achieving an effective hydrophilic surface processing. It is thus identified that the PP-PE fibrous absorbent member thus processed can satisfactorily serve as the ink absorbent member for the aqueous ink.

Then the fiber surface was observed by SEM photographs, in order to confirm formation of a polymer covering by the adhesion of polyalkylsiloxane with polyalkylene oxide chain on the PP-PE fibers in the surface modification of the present invention.

Figure 20:
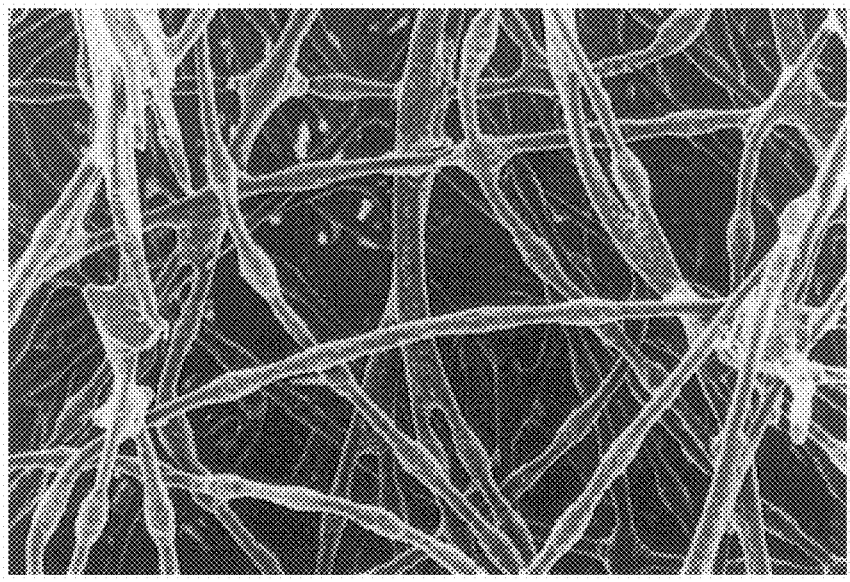
FIG. 20 is a SEM photograph of a magnification of 150× showing the form and surface state of unprocessed PP-PE (unprocessed PP-PE fibrous absorbent member) of a reference example 1.
Figure 21:
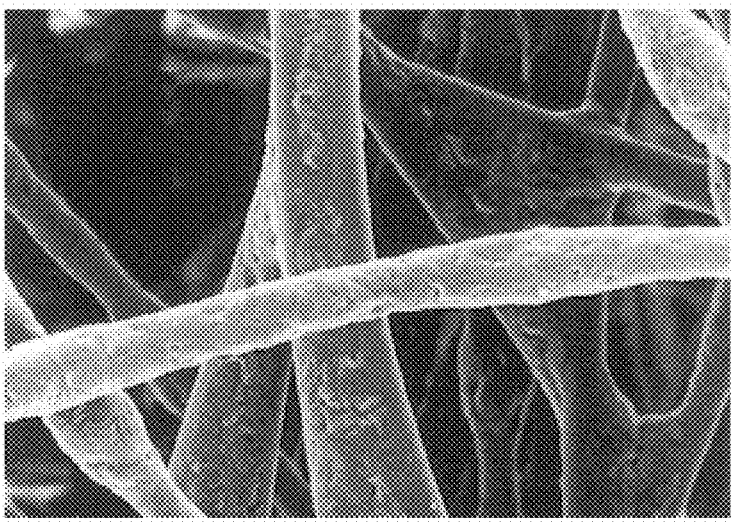
FIG. 21 is a SEM photograph of a magnification of 500× showing the form and surface state of unprocessed PP-PE (unprocessed PP-PE fibrous absorbent member) of the reference example 1.
Figure 22:
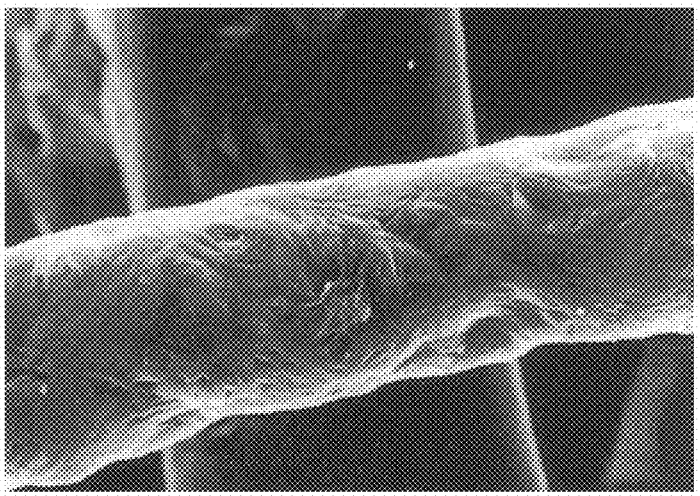
FIG. 22 is a SEM photograph of a magnification of 2000× showing the form and surface state of unprocessed PP-PE (unprocessed PP-PE fibrous absorbent member) of the reference example 1.

FIGS. 20, 21 and 22 are magnified SEM photographs of the unprocessed PP-PE fibers of the reference example 1 (unprocessed PP-PE fibrous absorbent body). Also FIG. 23 is a magnified SEM photograph of acid-processed PP-PE fibers of a comparative example 4 (PP-PE fibrous absorbent body processed with acid and alcohol only).

Figure 24:
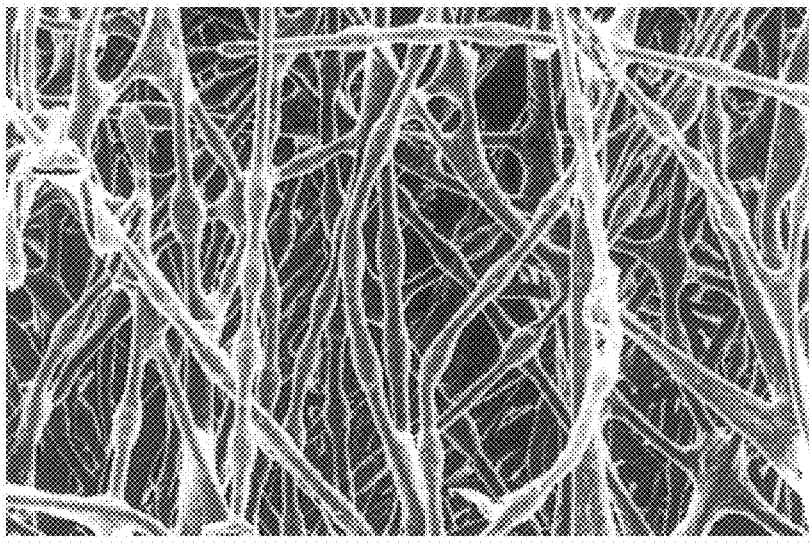
FIG. 24 is a SEM photograph of a magnification of 150× showing the form and surface state of processed PP-PE (hydrophilic processed PP-PE fibrous absorbent member) of a principle application example 1.
Figure 25:
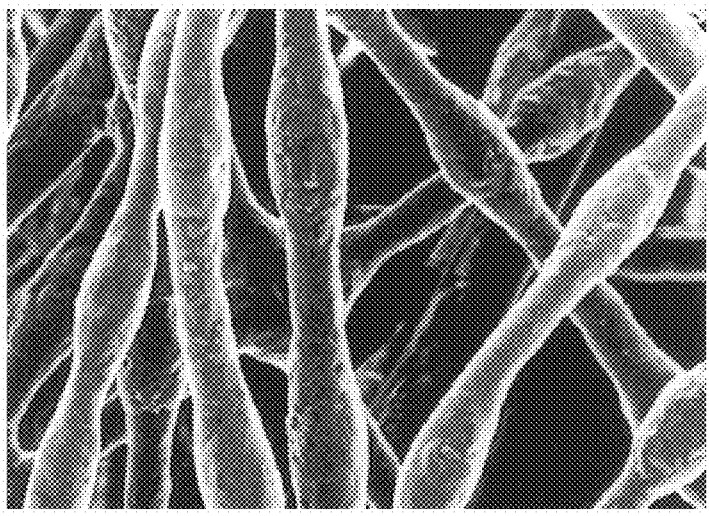
FIG. 25 is a SEM photograph of a magnification of 500× showing the form and surface state of processed PP-PE (hydrophilic processed PP-PE fibrous absorbent member) of a principle application example 1.
Figure 26:
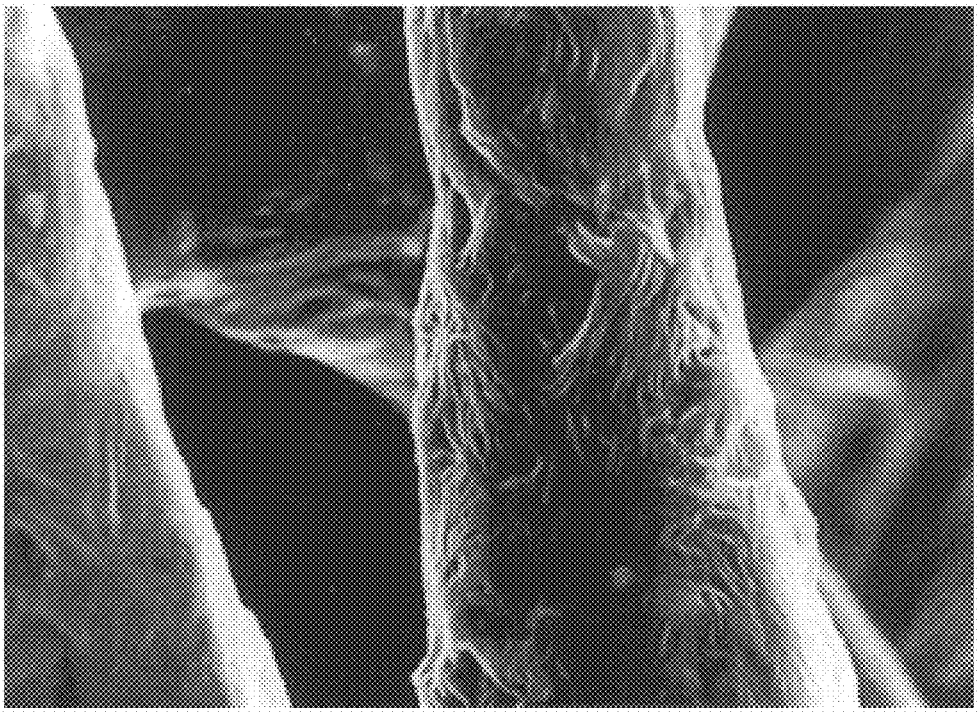
FIG. 26 is a SEM photograph of a magnification of 2000× showing the form and surface state of processed PP-PE (hydrophilic processed PP-PE fibrous absorbent member) of a principle application example 1.

FIGS. 24, 25 and 26 are magnified SEM photographs of the PP-PE fibers processed as explained in FIGS. 18A to 18C, 19A to 19C (hydrophilically processed PP-PE fibrous absorbent body).

In any of these magnified SEM photographs of the PP-PE fiber surface, there cannot be confirmed an evident structural change presumably resulting from the adhesion of an organic substance onto the fiber surface. In fact, even in detailed comparison of 2000× magnified SEM photographs, no difference can be observed between the unprocessed PP-PE fibers in FIG. 22 and the hydrophilic processed PP-PE fibers in FIG. 26. It is therefore estimated that, in the phydrophilic processed PP-PE fibers, the (polyoxyalkylene)-poly (dimethylsiloxane) adheres to the fiber surface as a uniform thin film (presumably a monomolecular film), thus showing no difference in shape from the original fiber surface.

Figure 23:
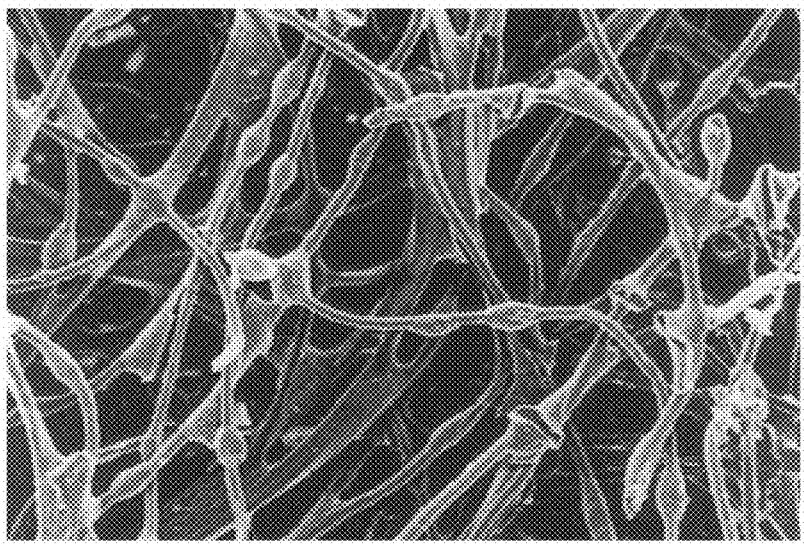
FIG. 23 is a SEM photograph of a magnification of 150× showing the form and surface state of acid-processed PP-PE (PP-PE fibrous absorbent member processed with acid and alcohol only) of a comparative example 1.

On the other hand, the SEM photograph of the PP-PE fibers processed with acid and alcohol only, shown in FIG. 23, shows frequent breakages of crossing points (fused points) of the fibers and many nodes in the fibers. These changes indicate that the deterioration of the PE-PP molecules on the fiber surface, particularly the surfacial PE, was induced and accelerated in the course of drying under heating, by the concentrated acid resulting from solvent evaporation and the heat of the drying process itself.

On the other hand, such breakages of fiber bonding portions and node formations in the fibers, as observed in the acid-processed PP-PE fibers processed with acid and alcohol only, are not observed in case of the hydrophilic processing though it involves same heat drying and the processing liquid containing the acid of a same concentration. This fact indicates that the deterioration of the PE molecules on the fiber surface is suppressed in the hydrophilic processing of the principle applied example 1. It is therefore assumed that, even when the acid induces breakage of the PE molecules on the fiber surface to generate a free radical in the molecule, a certain substance or structure captures such free radical thereby suppressing the destruction of the PE molecule by the free radical in a chain reaction. There cannot be denied an auxiliary effect that the surfacially adhered (polyoxyalkylene)-poly(dimethylsiloxane) is involved in the capture of such free radical and in forming a chemical bonding with PE surface by capturing the generated free radical, thereby suppressing the destruction of PP-PE molecules by a free radical chain reaction.

In consideration of the foregoing, the surface improvement in the principle applied example 1 can be judged to be achieved by the adhesion of (polyoxyalkylene)-poly (dimethylsiloxane) in the form of a thin uniform film on the fiber surface. In such process, there can also be expected a cleaning effect for the fiber surface by the acid and the solvent contained in the hydrophilic processing liquid, and there can also be anticipated an effect of accelerating physical absorption of the polyalkylene oxide chain. In addition, it is also conceivable that the broken portions of the PE molecules, broken by the concentrated acid and the heat, may possibly form chemical bondings with the polyalkylene oxide chain.

The principle applied example 1 also indicates that the polymer covering can be easily formed even on the fiber surface consisting of curved planes, as schematically shown in FIG. 19C. The polymer covering covers the periphery of the surface (a portion where the external periphery in cross section constitutes a closed loop) in annular manner, whereby the surfacially modified portion does not easily peel off from the article.

Figure 17B:
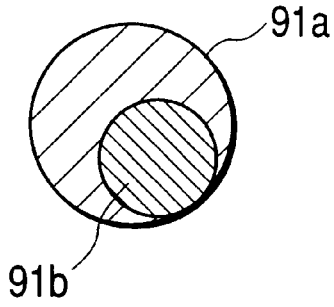

The biaxial fiber may contain a portion in which the core member 91*b* is positioned eccentrically as shown in FIG. 17B and is partially exposed to the external periphery whereby the external surface includes both a surface portion consisting of the core member and a surface portion consisting of the surfacial layer (sheath material) are mixed, but, even in such case, the aforementioned surface modifying process of the present invention allows to provide both the exposed portion of the core member and the portion of the surfacial layer with hydrophilicity. Also, the hydrophilicity can be initially obtained, though locally, by merely coating and drying a surfactant having a hydrophilic function, but such hydrophilicity is lost by the dissolution of the surfactant by washing with purified water under gentle rubbing.

Principle Applied Examples 2, 3

In the following there will be explained examples of applying the principle of the aforementioned hydrophilic surface processing to a PP fibrous body. More specifically, there was employed a PP fibrous body having a fiber diameter of 2 deniers and formed into a rectangle of 2×2×3 cm.

At first there were prepared hydrophilic processing liquids of following two compositions:

TABLE 2

Composition of hydrophilic processing liquid:

| Component | Composition (wt. %) |
|---|---|
| (polyoxyalkylene)-poly(dimethylsiloxane) | 0.1 |
| sulfuric acid | 0.0125 |
| isopropyl alcohol | 99.8875 |

TABLE 3

Composition of hydrophilic processing liquid:

| Component | Composition (wt. %) |
|---|---|
| (polyoxyalkylene)-poly(dimethylsiloxane) | 0.1 |
| sulfuric acid | 0.0125 |
| isopropyl alcohol | 40.0 |
| purified water | 59.8875 |

The second composition (principle applied example 3) was obtained by adding isopropyl alcohol and purified water in the indicated order by respectively specified amounts. Also in this case, (polyoxyalkylene)-poly(dimethylsiloxane) and sulfuric acid contained in the composition were diluted 4 times.

The procedure of the hydrophilic processing for the PP-PE fibrous absorbent body, explained in FIGS. 18A to 18C, 19A to 19C, was similarly applied to obtain a PP fibrous body (principle applied example 2) processed with the liquid of the first composition (Table 2) employing isopropyl alcohol as the principal solvent and a PP fibrous body (principle applied example 3) processed with the liquid of the second composition (Table 3) employing isopropyl alcohol and water as the mixed solvent.

Reference Example 2

Ab unprocessed PP fibrous body was employed as the reference example 2.

As in the principle applied example 1, the unprocessed PP fibrous body of the reference example 2 had a water-repellent surface, but the PP fibrous bodies of the principle applied examples 2 and 3 were both surface modified to hydrophilic. In order to evaluate the level of hydrophilicity, 7 g of aqueous ink ($\gamma$=46 dyn/cm) was placed in a glass plate and the PP fibrous body of the principle applied example 2, that of the principle applied example 3 and the unprocessed PP fibrous body of the reference example were respectively placed gently on the ink surface.

The unprocessed PP fibrous body of the reference example 2 floated on the aqueous ink, but the PP fibrous bodies of the principle applied examples 2 and 3 both absorbed ink from the bottom face of the fibrous body. However there was a distinct difference in the amount of the absorbed aqueous ink between the fibrous bodies of the principle applied examples 2 and 3, and the former picked up and absorbed all the ink in the glass plate while, in the latter case, about half of the ink remained in the glass plate.

This result is probably ascribable to a fact that, though the total amount of (polyoxyalkylene)-poly(dimethylsiloxane) constituting the surface covering polymer is not substantially different between the PP fibrous bodies of the principle applied examples 2 and 3, there is a difference in the level of orientation of the polymer itself in such covering.

More specifically, in the PP fibrous body of the principle applied example 2, the surface covering polymer is generally oriented but the adhesion is completed in a state containing partial distortion in the orientation. On the other hand, in the PP fibrous body of the principle applied example 3, such distortion in orientation is significantly reduced.

The hydrophilic processing with (polyoxyalkylene)-poly-(dimethylsiloxane) is considered to attain a denser covering with a higher level of orientation by adding water to the solvent in addition to isopropyl alcohol. As the processing liquid itself is required to uniformly wet the surface, it desirably contains isopropyl alcohol by at least about 20%, but the covering can also be achieved with a content of isopropyl alcohol less than the content of 40% in the foregoing principle applied example 3. More specifically, isopropyl alcohol should be lost by faster evaporation in the course of drying by solvent evaporation thereby resulting in a lower concentration of isopropyl alcohol, and, in consideration of this fact, the covering should be possible with a content of isopropyl alcohol less than the content of 40% in the principle applied example 3. Also the content of isopropyl alcohol is preferably not exceeding 40% in consideration of industrial safety.

The aforementioned surface modifying method of the present invention and the aforementioned technical concept on the modified surface or article are naturally applicable to any porous body other than the fibers serving as the negative pressure generating member. Furthermore, the aforementioned surface modifying method and the aforementioned technical concept of the present invention are applicable also to the internal wall of the supply tube 7 connected to the large tank 6 as shown in FIGS. 4 to 7.

Furthermore, the negative pressure generating member, hydrophilically processed in uniform manner by the method explained in the foregoing (in the auxiliary explanation on surface modifying method), provides an advantage, in the repeated ink absorption after the ink impregnated in such member is extracted, of retaining an approximately same amount of ink in the re-absorption, namely restoring the initial negative pressure.

In the present invention, as explained in the foregoing, a polymer is applied to the surface of an absorbent member, contained in a liquid container mounted as the tank unit on the carriage, to render such surface hydrophilic, whereby provided is an advantage that the liquid replenished to such absorbent member is promptly absorbed therein and the liquid replenishing operation can be completed within a short time. In a liquid discharge recording apparatus in which such liquid container is mounted together with the recording head on the carriage, when the liquid is replenished to the absorbent member in the tank unit when the liquid therein decreases by the liquid discharge operation of the recording head, the liquid penetrating in the absorbent member reaches the gas-liquid interface therein within a short time. Stated differently, the replenished liquid becomes connected, in the absorbent member, with the liquid present therein prior to the replenishment within a short time. Thus, in comparison with a case where the surface of the absorbent member is not hydrophilically processed, the time required by the tank unit to reach a usable state can be significantly reduced. It is therefore possible to achieve prompt and secure liquid replenishment to the tank unit, and to reduce the time from the start of the liquid replenishing operation to the sufficient filling of the tank unit with the liquid in the usable state. Consequently there can be realized a highly reliable liquid discharge recording apparatus of pit-in system in which the liquid replenishment to the tank unit mounted on the carriage is executed in a predetermined position.

Also in case such liquid container is mounted as the tank unit on the carriage and the liquid in the replenishing tank is replenished to the tank unit through a tubular liquid supply path when the carriage is moved to a predetermined position, the lyophilic processing is applied in the liquid supply path, at least on the internal surface at the downstream end portion in the liquid supplying direction, whereby attained is an effect of stably forming a meniscus at such end portion of the liquid supply path during the interval of the liquid replenishing operations, thereby suppressing the ink leakage from such end portion. For example in case of a vibration generated in the recording apparatus for example by carriage movement or an impact applied to the recording apparatus, the meniscus can be maintained in a stable form at the end portion of the ink supply path, and is not easily broken. Consequently there can be suppressed the ink leakage from the end portion of the liquid supply path in the interval between the liquid replenishing operation to the tank unit on the carriage, and there can be secured highly reliable ink supply in the ink replenishment to the tank unit.

What is claimed is:

1. A liquid container containing an absorbent member for temporarily retaining, by a capillary force, liquid to be supplied to a recording head for discharging the liquid and mounted together with said recording head on a linearly reciprocating carriage and adapted for receiving liquid replenishment to said absorbent member when said carriage is moved to a predetermined position:

wherein, to the surface of said absorbent member, there is applied a polymer provided with a second portion having a lyophilic radical for rendering said surface lyophilic and a first portion having a radical of an interfacial energy different from the interfacial energy of said lyophilic radical but is approximately equal to the surfacial energy of said surface, and said first portion is oriented toward said surface while said second portion is oriented in a direction different from said surface.

2. A liquid container according to claim 1, wherein said absorbent member is a fibrous body provided with olefinic resin at least on the surface thereof, and said polymer is polyalkylsiloxane provided with a lyophilic radical.

3. A liquid supply system comprising a tank unit containing an absorbent member for temporarily retaining, by a capillary force, liquid to be supplied to a recording head for discharging the liquid and mounted together with said recording head on a linearly reciprocating carriage; and a replenishing tank for holding liquid to replenished to said tank unit when said carriage is moved to a predetermined position:

wherein, to the surface of said absorbent member, there is applied a polymer provided with a second portion having a lyophilic radical for rendering said surface lyophilic and a first portion having a radical of an interfacial energy different from the interfacial energy of said lyophilic radical but is approximately equal to the surfacial energy of said surface, and said first portion is oriented toward said surface while said second portion is oriented in a direction different from said surface.

4. A liquid supply system according to claim 3, wherein said absorbent member is a fibrous body provided with olefinic resin at least on the surface thereof, and said polymer is polyalkylsiloxane provided with a lyophilic radical.

5. A liquid supply system comprising a tank unit for retaining liquid to be supplied to a recording head for discharging the liquid and mounted together with said recording head on a linearly reciprocating carriage;

a replenishing tank for holding liquid to replenished to said tank unit when said carriage is moved to a predetermined position; and a tubular liquid supply path of which an end thereof is connected to said replenishing tank for supplying the liquid therein to said tank unit and the other end is positioned above said tank when said carriage is moved to said predetermined position:

wherein, to the internal surface of said liquid supply path, there is applied a polymer provided with a second portion having a lyophilic radical for rendering said internal surface lyophilic and a first portion having a radical of an interfacial energy different from the interfacial energy of said lyophilic radical but is approximately equal to the surfacial energy of said internal surface, and said first portion is oriented toward said internal surface while said second portion is oriented in a direction different from said surface.

6. A liquid supply system according to claim 5, wherein the internal surface, to which said polymer is applied, of said liquid supply path is composed of olefinic resin and said polymer is polyalkylsiloxane provided with a lyophilic radical.

7. A liquid supply system comprising a tank unit containing an absorbent member for temporarily retaining, by a capillary force, liquid to be supplied to a recording head for discharging the liquid and mounted together with said recording head on a linearly reciprocating carriage;

a replenishing tank for holding liquid to replenished to said tank unit when said carriage is moved to a predetermined position: and a tubular liquid supply path of which an end thereof is connected to said replenishing tank for supplying the liquid therein to said tank unit and the other end is positioned above said tank when said carriage is moved to said predetermined position:

wherein the surface of said absorbent member and the internal surface of said liquid supply path are rendered lyophilic, and, in said lyophilic surface, there is applied a polymer provided with a second portion having a lyophilic radical for rendering said surface lyophilic and a first portion having a radical of an interfacial energy different from the interfacial energy of said lyophilic radical but is approximately equal to the surfacial energy of said surface, and said first portion is oriented toward said surface while said second portion is oriented in a direction different from said surface.

8. A liquid discharge recording apparatus comprising a carriage supporting a tank unit containing an absorbent member for temporarily holding liquid by a capillary force and a recording head for executing recording by discharging, toward a recording medium, the liquid supplied from said tank unit and reciprocating linearly parallel to said recording medium; and a replenishing tank for holding liquid to be supplied to said tank unit when said carriage is moved to a predetermined position;

wherein, to the surface of said absorbent member, there is applied a polymer provided with a second portion having a lyophilic radical for rendering said surface lyophilic and a first portion having a radical of an interfacial energy different from the interfacial energy of said lyophilic radical but is approximately equal to the surfacial energy of said surface, and said first portion is oriented toward said surface while said second portion is oriented in a direction different from said surface.

9. A liquid discharge recording apparatus according to claim 8, further comprising a tubular liquid supply path of which an end thereof is connected to said replenishing tank for supplying the liquid therein to said tank unit and the other end is positioned above said tank when said carriage is moved to said predetermined position:

wherein, to the internal surface of said liquid supply path, there is applied a polymer provided with a second portion having a lyophilic radical for rendering said internal surface lyophilic and a first portion having a radical of an interfacial energy different from the interfacial energy of said lyophilic radical but is approximately equal to the surfacial energy of said internal surface, and said first portion is oriented toward said internal surface while said second portion is oriented in a direction different from said surface.

10. A liquid discharge recording apparatus according to claim 8, wherein said replenishing tank is provided in plural units with different kinds of liquids held therein and said tank unit is provided in plural units respectively corresponding to said replenishing tanks of different kinds.

* * * * *

UNITED STATES PATENT AND TRADEMARK OFFICE

CERTIFICATE OF CORRECTION

PATENT NO. : 6,692,115 B2
DATED : February 17, 2004
INVENTOR(S) : Mikio Sanada et al.

It is certified that error appears in the above-identified patent and that said Letters Patent is hereby corrected as shown below:

Column 5,
Line 9, “prompr” should read -- prompt --.

Column 6,
Line 7, “mer” should read -- polymer --.

Column 12,
Line 27, “to” should read -- be --.

Column 17,
Line 15, “centration” should read -- concentration --.

Column 19,
Line 31, “60ºC.” should read -- 60ºC). --

Column 22,
Line 60, “phydrophilic” should read -- hydrophilic --.

Column 24,
Line 43, “Ab” should read -- An --.

Column 26,
Line 5, “to” should read -- to be --.

Column 27,
Lines 8 and 37, “to” should read -- to be --.

Signed and Sealed this

Twenty-eighth Day of September, 2004

JON W. DUDAS
*Director of the United States Patent and Trademark Office*